US010315215B2

(12) United States Patent
Higgins et al.

(10) Patent No.: US 10,315,215 B2
(45) Date of Patent: Jun. 11, 2019

(54) APPARATUSES, SYSTEMS, AND METHODS FOR APPLYING A VISCOUS MATERIAL

(71) Applicant: The Boeing Company, Chicago, IL (US)

(72) Inventors: Roger Higgins, Goose Creek, SC (US); Joseph B. Keehner, Walterboro, SC (US); Emily C. Mikkelson, Mount Pleasant, SC (US)

(73) Assignee: The Boeing Company, Chicago, IL (US)

( * ) Notice: Subject to any disclaimer, the term of this patent is extended or adjusted under 35 U.S.C. 154(b) by 738 days.

(21) Appl. No.: 14/681,733

(22) Filed: Apr. 8, 2015

(65) Prior Publication Data

US 2016/0296951 A1 Oct. 13, 2016

(51) Int. Cl.

*B05C 17/005* (2006.01)
*B05C 11/10* (2006.01)
*B05C 5/02* (2006.01)

(52) U.S. Cl.

CPC ..... *B05C 5/0225* (2013.01); *B05C 5/0262* (2013.01); *B05C 11/1031* (2013.01); *B05C 17/00516* (2013.01)

(58) Field of Classification Search

CPC ..... B05C 5/0262; B05C 5/0225; B05C 5/027; B05C 5/0266; B05C 17/00503; B05C 17/00516; B05C 17/00576; B05C 17/00583; B05C 17/00593; B05C 17/0146

USPC ..... 222/502, 527–529, 566

See application file for complete search history.

(56) References Cited

U.S. PATENT DOCUMENTS 4,344,990 A * 8/1982 Wollam ..... B05C 3/18 118/410
4,362,122 A * 12/1982 Choinski ..... B05C 9/06 118/407
4,938,994 A * 7/1990 Choinski ..... B05C 5/0254 118/401
5,067,432 A * 11/1991 Lippert ..... B05C 5/0262 118/413
5,350,600 A * 9/1994 Kubota ..... B05C 5/0216 118/301
5,464,577 A * 11/1995 Leonard ..... B29C 47/0021 118/410
5,824,155 A * 10/1998 Ha ..... H05K 3/1233 118/410

(Continued)

FOREIGN PATENT DOCUMENTS

JP 2014168746 A * 9/2014 ..... H01L 21/52

OTHER PUBLICATIONS http://solutions.3m.com/wps/portal/3M/en_US/Adhesives/Tapes/Products/~/Industrial-Adhesives-Tapes/Adhesive-Dispensers-Applicators-Accessories?N=5396408&rt=r3 accessed Apr. 16, 2105.

*Primary Examiner* — Karl Kurple
(74) *Attorney, Agent, or Firm* — Kunzler Bean & Adamson

(57) ABSTRACT

An apparatus for applying a viscous material to a surface of a workpiece is disclosed. The apparatus comprises a channel comprising an inlet and an outlet. The channel has a width CW that increases from the inlet to the outlet. The apparatus also comprises dividers inside the channel. The channel further comprises subdivisions formed by the dividers. The subdivisions of the channel are in communication with the inlet and the outlet of the channel. At least one of the subdivisions of the channel has a width SW that increases from the inlet of the channel to the outlet of the channel.

38 Claims, 15 Drawing Sheets

(56) References Cited

U.S. PATENT DOCUMENTS

| | | | | |
|---|---|---|---|---|
| 6,410,094 | B2 * | 6/2002 | Mandai | B05C 5/0262 427/356 |
| 6,419,747 | B1 * | 7/2002 | Vinson | B05C 5/0254 118/411 |
| 6,423,144 | B1 * | 7/2002 | Watanabe | B05C 5/002 118/410 |
| 2003/0080307 | A1 * | 5/2003 | Jackson | B05C 5/0258 251/205 |
| 2003/0131791 | A1 * | 7/2003 | Schultz | B05B 13/0431 118/324 |
| 2004/0124251 | A1 * | 7/2004 | Gressett, Jr. | B05B 7/0861 239/1 |
| 2004/0173148 | A1 * | 9/2004 | Kim | B05C 5/0254 118/670 |
| 2014/0102360 | A1 * | 4/2014 | Kitani | B29C 47/16 118/300 |
| 2017/0065987 | A1 * | 3/2017 | Pahl | B05D 1/02 |

* cited by examiner

APPARATUSES, SYSTEMS, AND METHODS FOR APPLYING A VISCOUS MATERIAL

BACKGROUND

The application of a viscous material onto a surface of a workpiece is a routine step of the process for manufacturing a variety of components. The viscous material may be a sealant or an adhesive used to adhere the workpiece to another component. Structural performance of the viscous material depends on proper distribution of the viscous material onto the workpiece, which is difficult to achieve with conventional applicator tips.

SUMMARY

Accordingly, apparatuses and methods, intended to address at least the above-identified concerns, would find utility.

The following is a non-exhaustive list of examples, which may or may not be claimed, of the subject matter according the present disclosure.

One example of the present disclosure relates to an apparatus for applying a viscous material to a surface of a workpiece. The apparatus comprises a channel comprising an inlet and an outlet. The channel has a width CW that increases from the inlet to the outlet. The apparatus also comprises dividers inside the channel. The channel further comprises subdivisions formed by the divider. The subdivisions of the channel are in communication with the inlet and the outlet of the channel. At least one of the subdivisions of the channel has a width SW that increases from the inlet of the channel to the outlet of the channel.

Another example of the present disclosure relates to a system for applying a viscous material to a surface of a workpiece. The system comprises a channel comprising an inlet and an outlet. The channel has a width CW that increases from the inlet to the outlet. The system also comprises dividers inside the channel. The channel further comprises subdivisions formed by the dividers. The subdivisions of the channel are in communication with the inlet and the outlet of the channel. At least one of the subdivisions of the channel has a width SW that increases from the inlet of the channel to the outlet of the channel. The system further comprises a material supply device coupled to the channel. The material supply device is configured to supply the viscous material to the channel.

Yet another example of the present disclosure relates to a method of applying a viscous material onto a surface of a workpiece as a layer having a thickness. The method comprises establishing contact between an apparatus and the surface of the workpiece at an angle $\alpha$. The apparatus comprises a channel comprising an inlet and an outlet. The channel comprises a width CW that increases from the inlet of the channel to the outlet of the channel. The method further comprises uniformly distributing the viscous material across the width CW of the channel while urging the viscous material through the channel from the inlet to the outlet. Additionally, the method comprises evenly distributing the viscous material from the outlet onto the surface of the workpiece as the layer. The layer has a width LW equal to a length OL of the outlet and a thickness less than or equal to a width OW of the outlet. The width LW of the layer is uniform. The thickness of the layer is uniform.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a system for applying a viscous material to a surface of a workpiece, according to one or more examples of the present disclosure;

FIG. 2 is a schematic perspective view of an apparatus of the system of FIG. 1, according to one or more examples of the present disclosure;

FIG. 3 is a schematic top plan view of the apparatus of FIG. 2, according to one or more examples of the present disclosure;

FIG. 4 is a schematic section, top plan view of the apparatus of FIG. 2, according to one or more examples of the present disclosure;

FIG. 5 is a schematic perspective view of the apparatus of FIG. 2, according to one or more examples of the present disclosure;

FIG. 6 is a schematic perspective view of the apparatus of FIG. 2, according to one or more examples of the present disclosure;

FIG. 7 is a schematic section, side elevation view of the apparatus of FIG. 2, according to one or more examples of the present disclosure;

FIG. 8 is a schematic section, side elevation view of the apparatus of FIG. 2, according to one or more examples of the present disclosure;

FIG. 9 is a schematic perspective view of an apparatus of the system of FIG. 1, according to one or more examples of the present disclosure;

FIG. 10 is a schematic bottom plan view of the apparatus of FIG. 9, according to one or more examples of the present disclosure;

FIG. 11 is a schematic bottom plan view of the apparatus of FIG. 9, according to one or more examples of the present disclosure;

Figure 1:
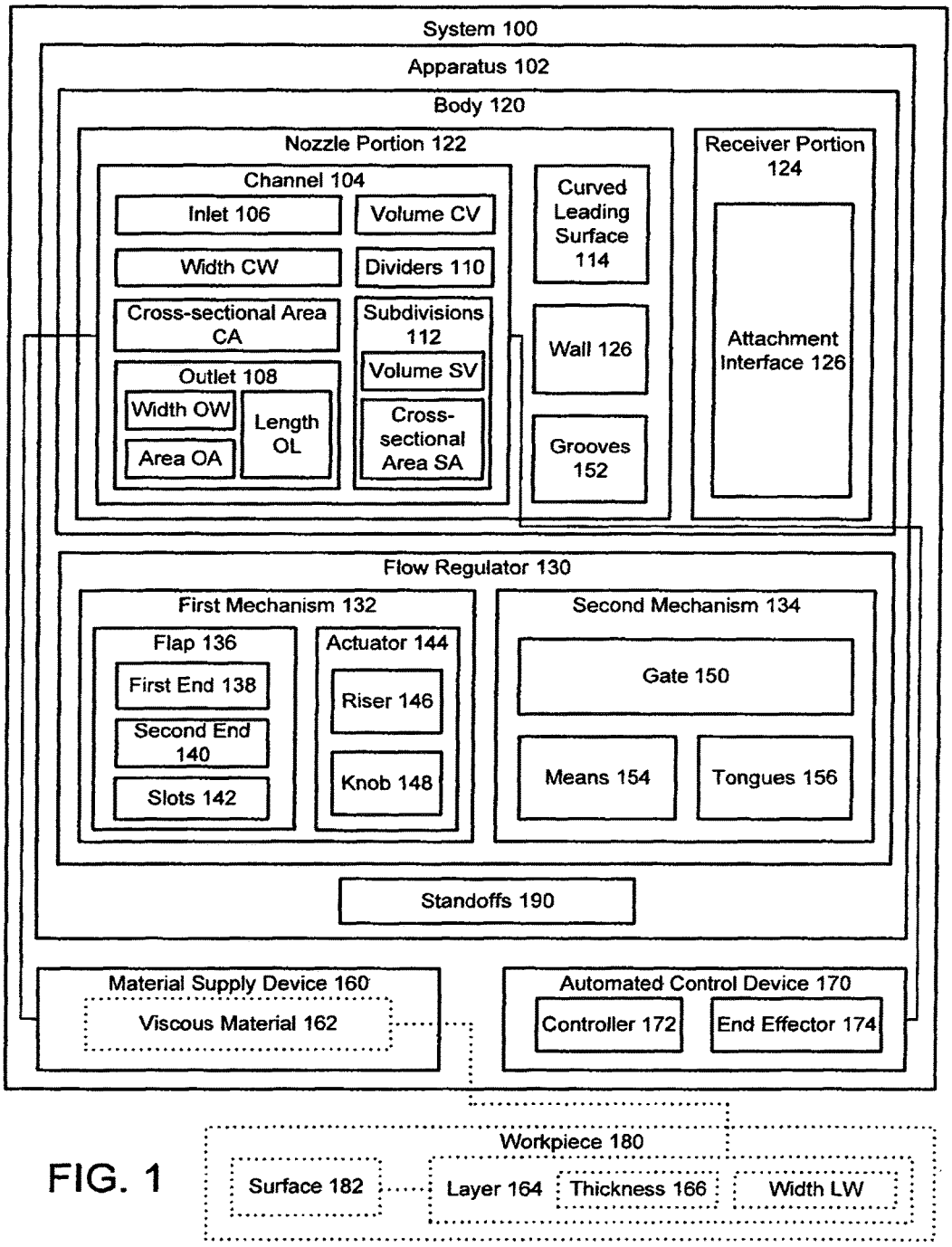
Figure 9:
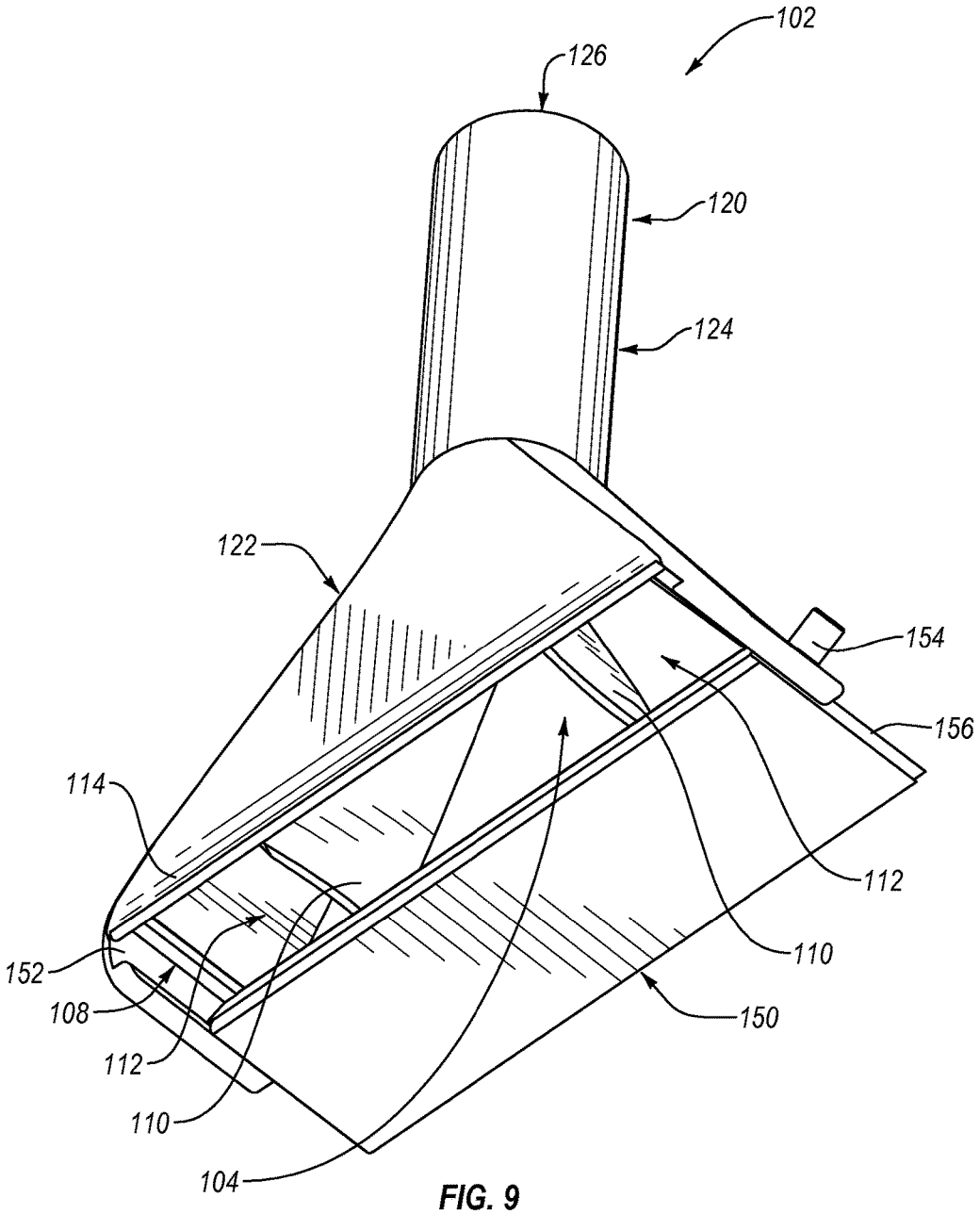
Figure 10:
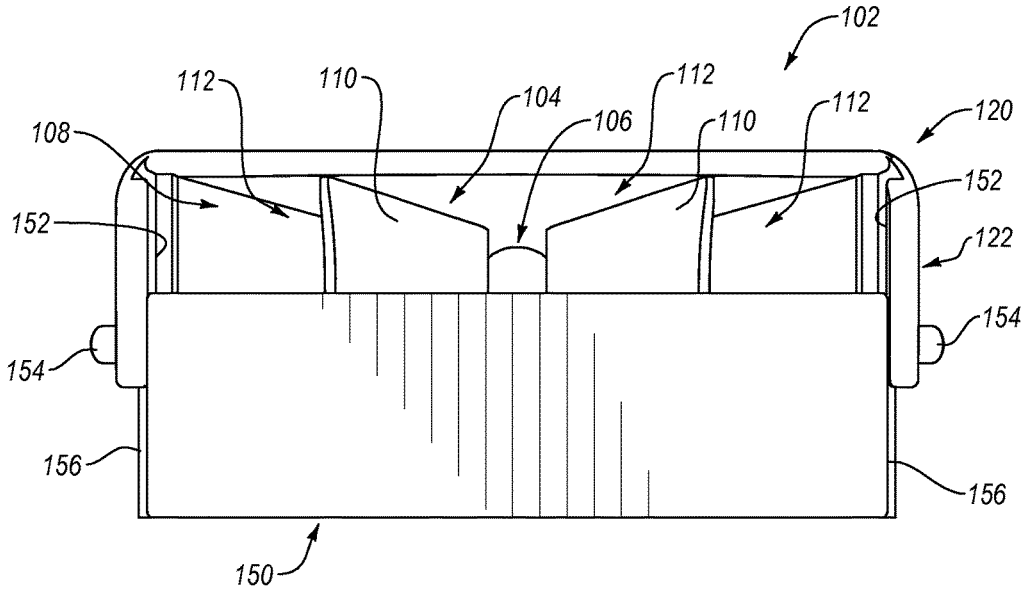
Figure 11:
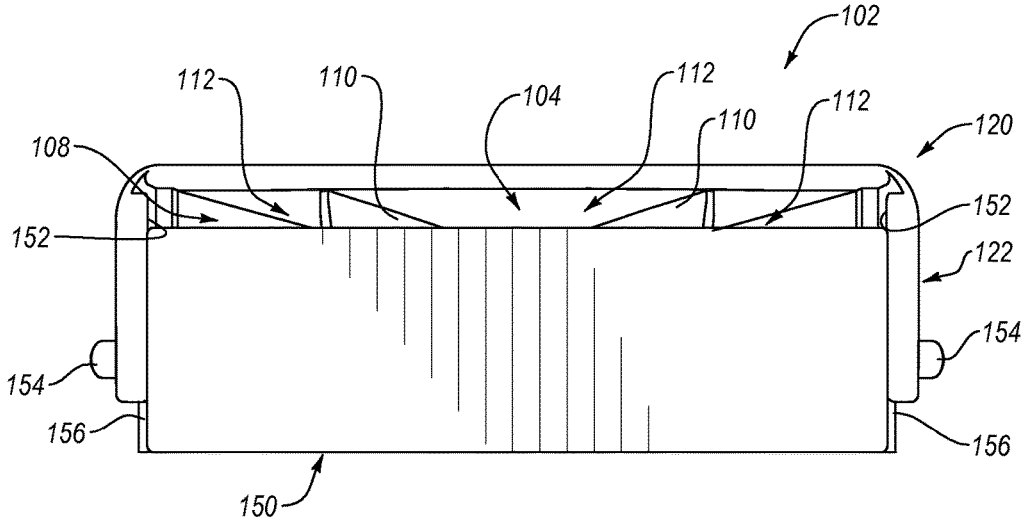
Figure 12:
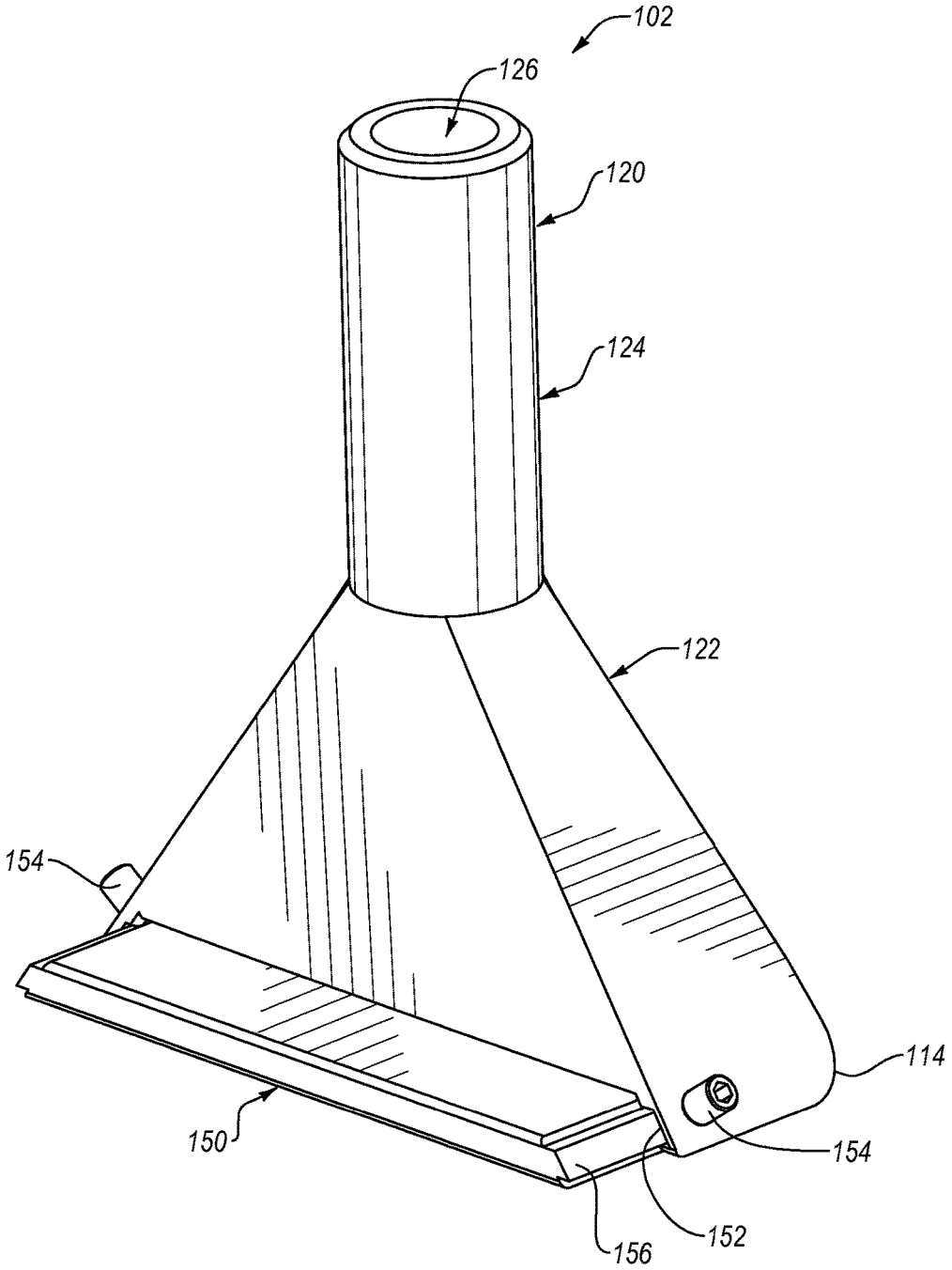
Figure 13:
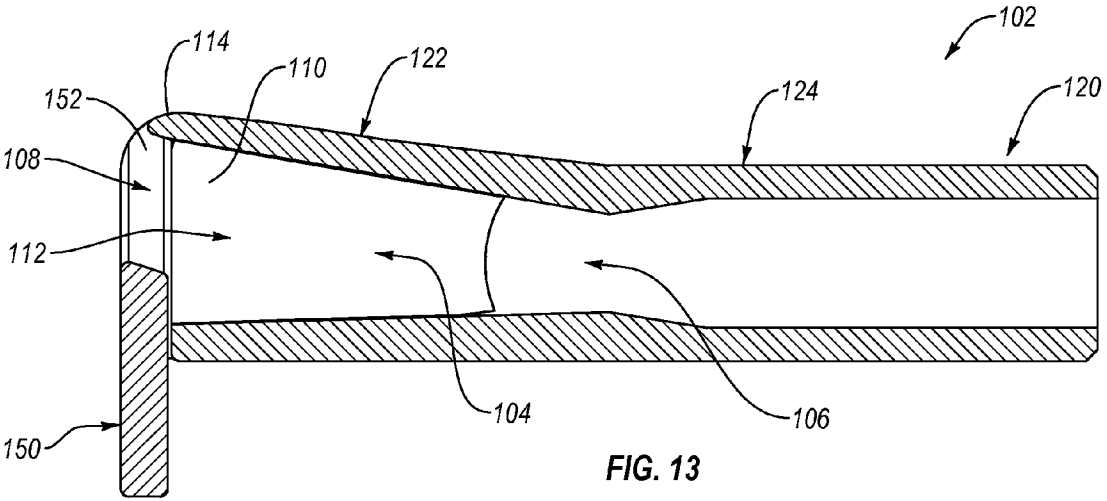
Figure 14:
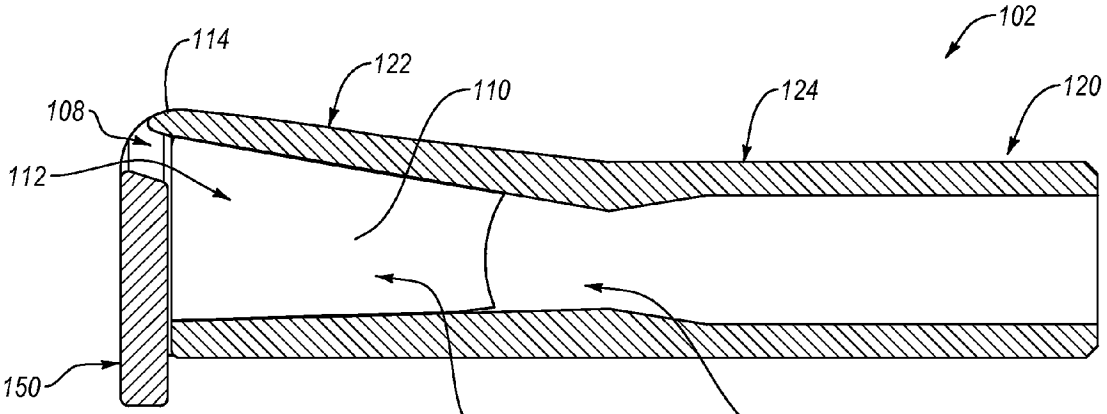
Figure 15:
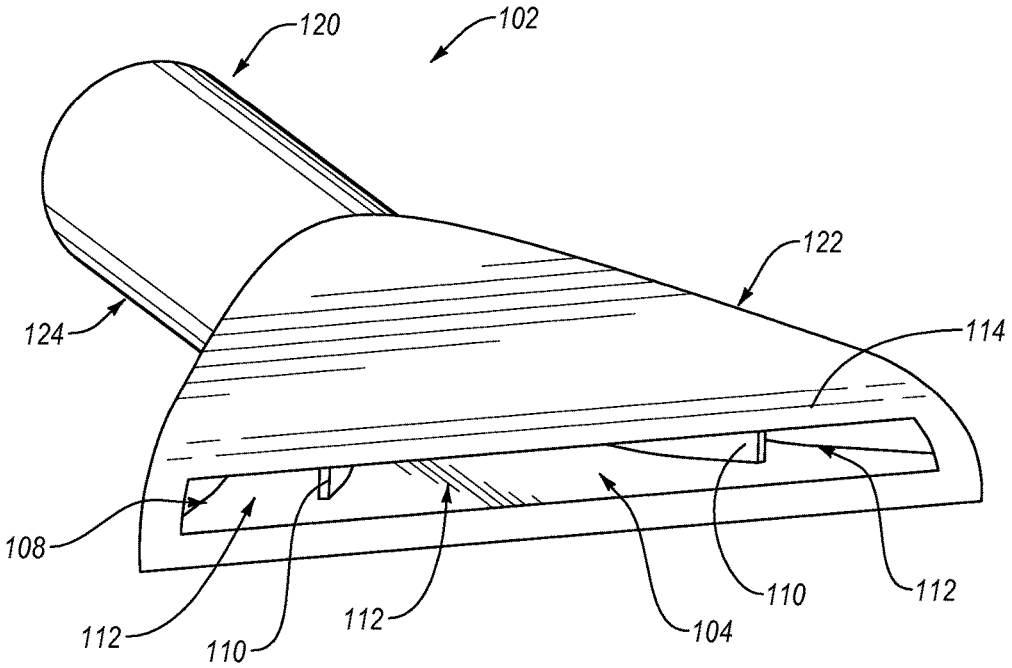
Figure 16:
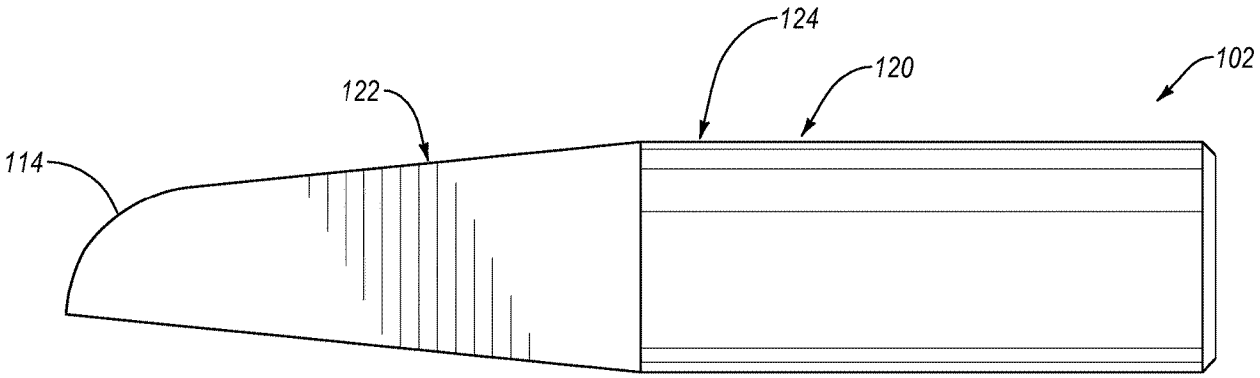
Figure 17:
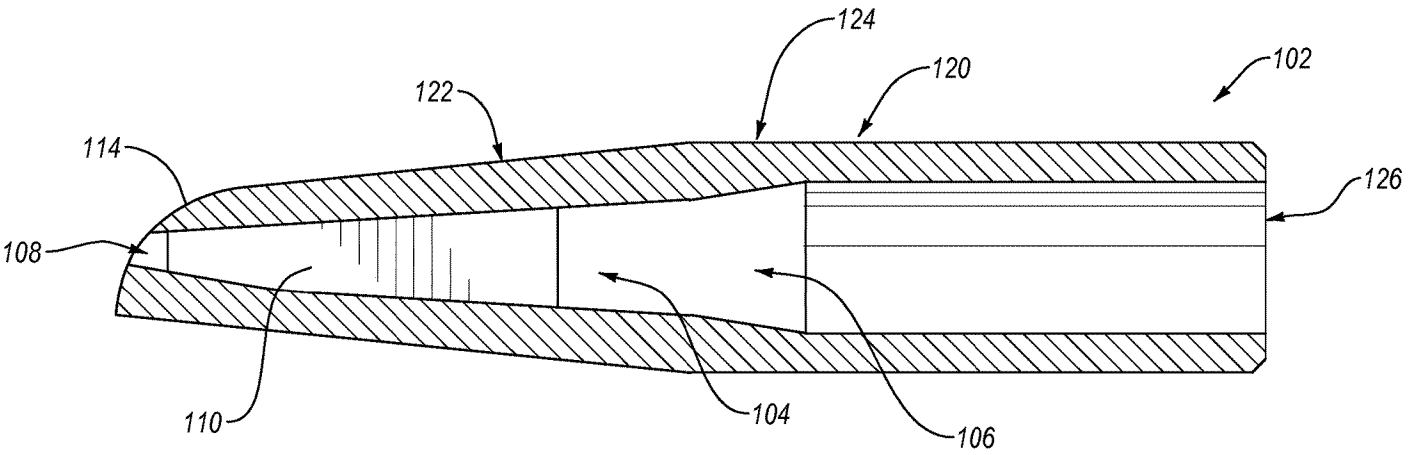
Figure 18:
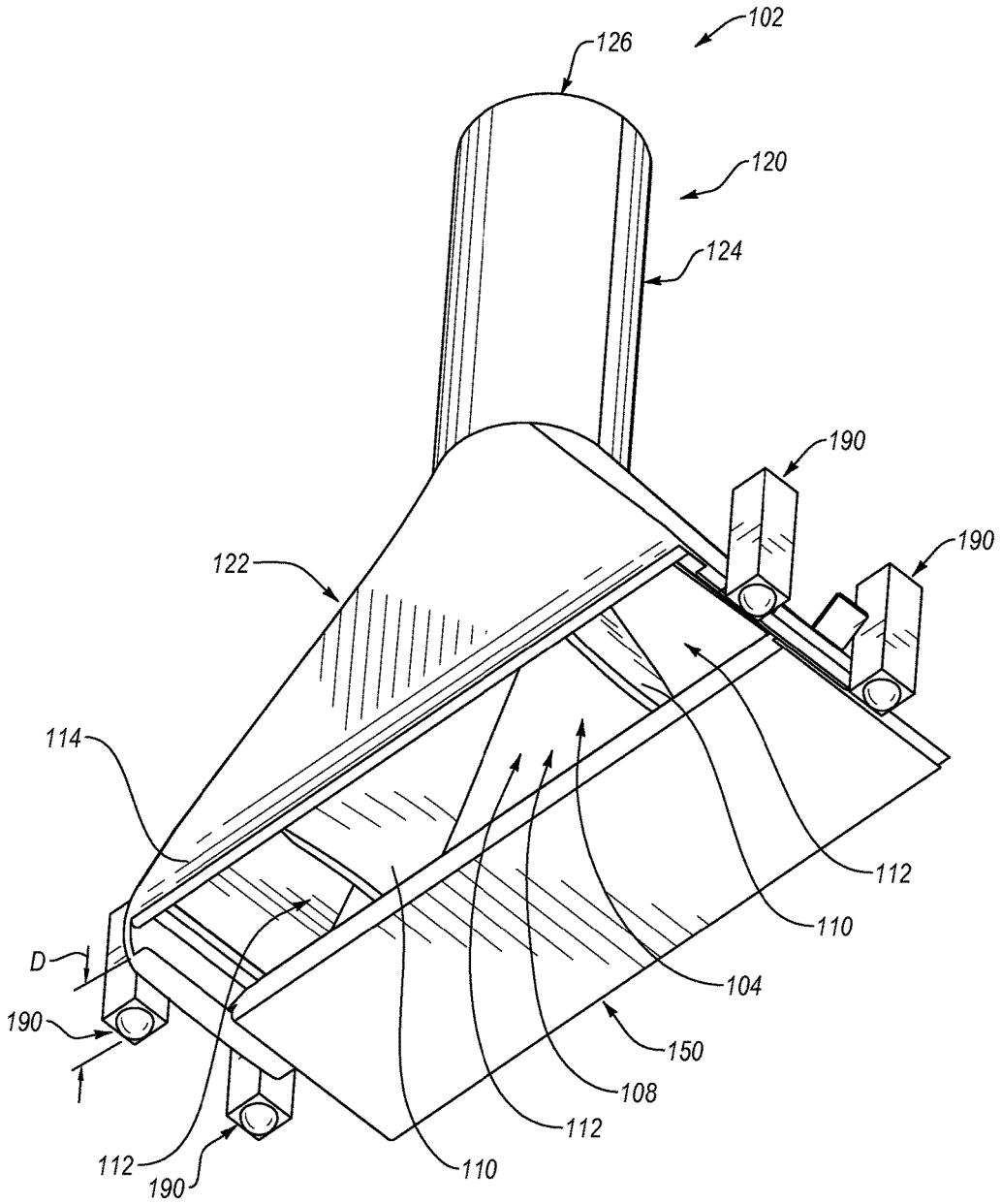
Figure 19:
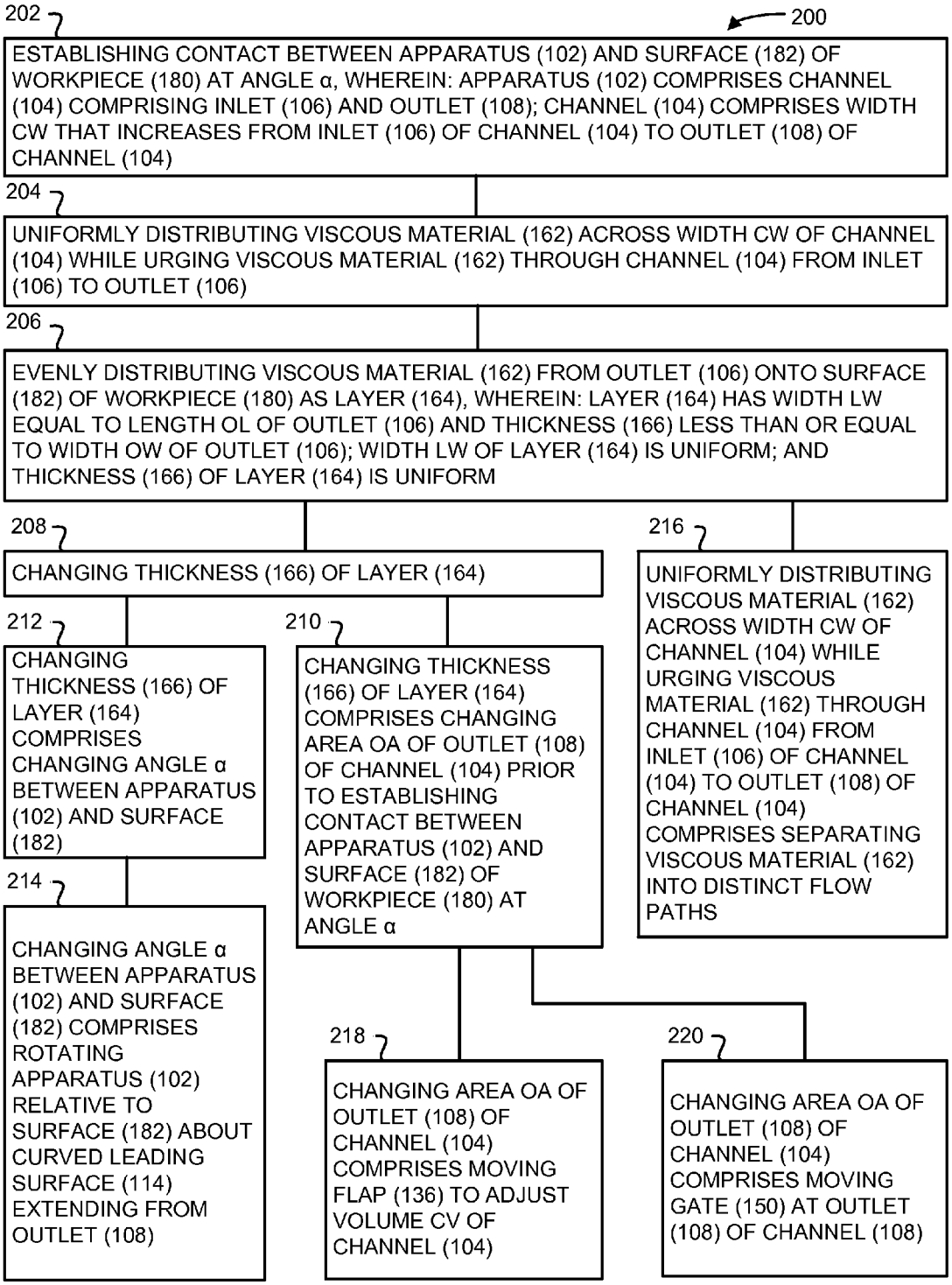
Figure 20:
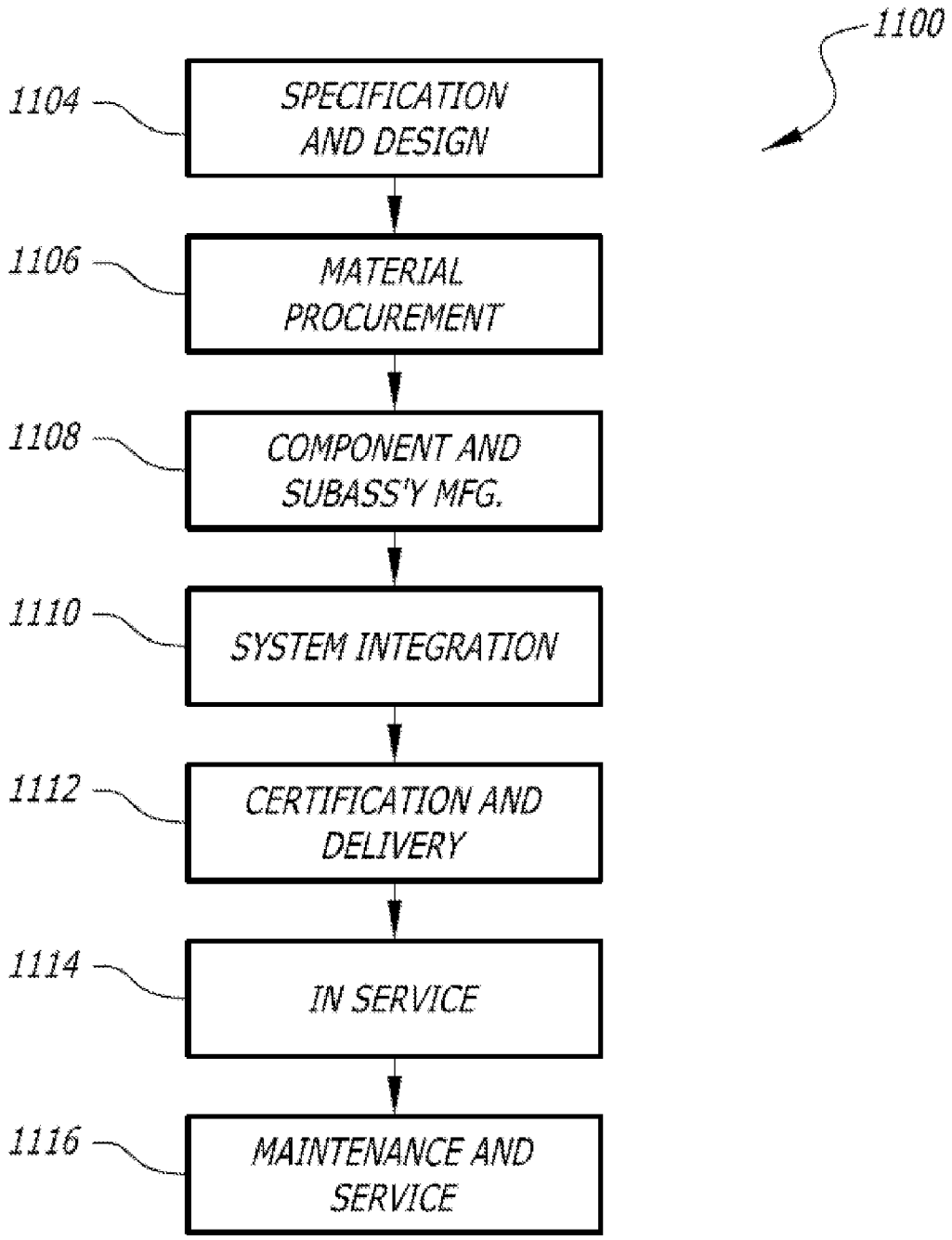
Figure 21:
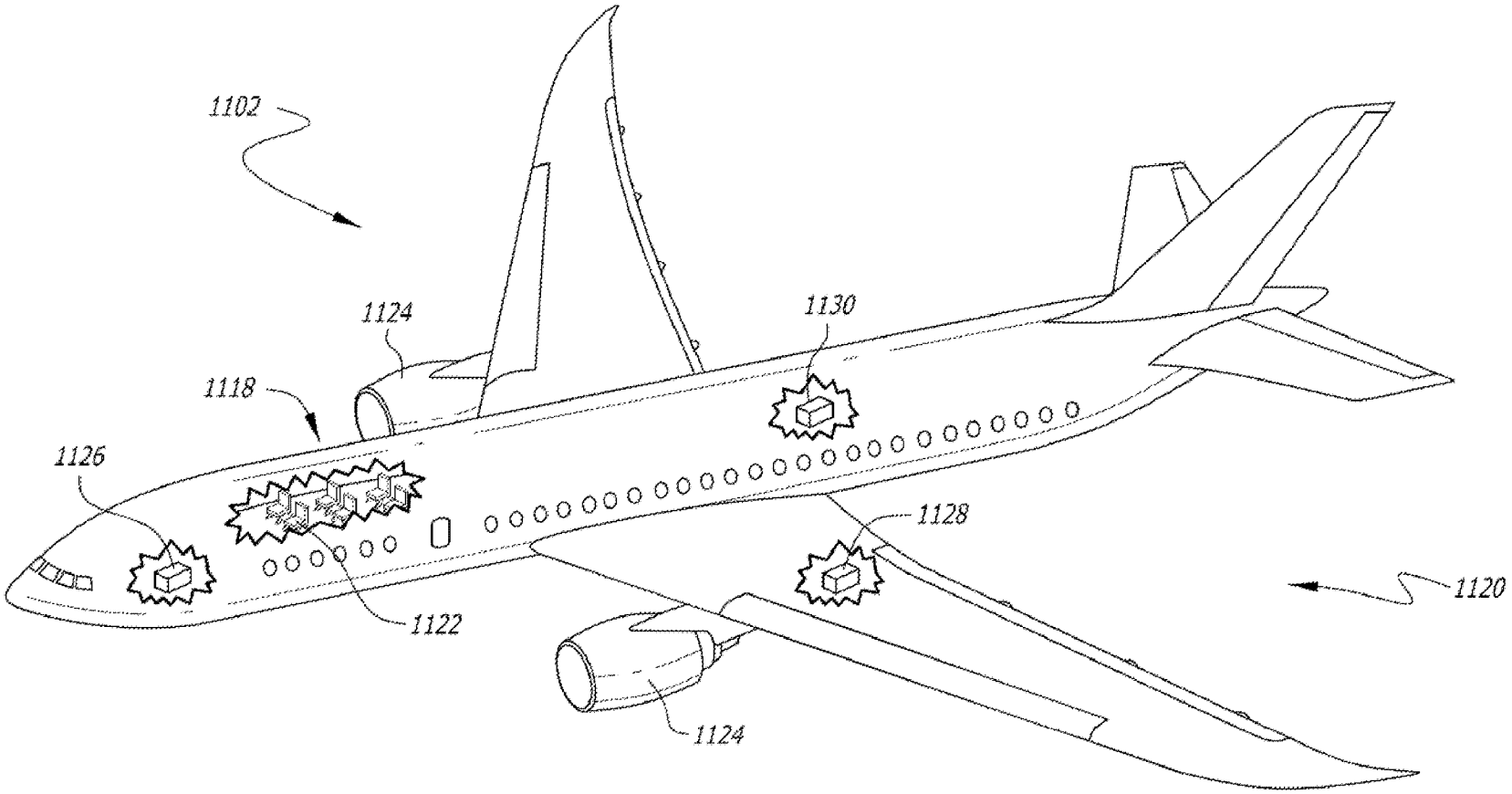

FIG. 12 is a schematic perspective view of the apparatus of FIG. 9, according to one or more examples of the present disclosure;

FIG. 13 is a schematic section, side elevation view of the apparatus of FIG. 9, according to one or more examples of the present disclosure;

FIG. 14 is a schematic section, side elevation view of the apparatus of FIG. 9, according to one or more examples of the present disclosure;

FIG. 15 is a schematic perspective view of an apparatus of the system of FIG. 1, according to one or more examples of the present disclosure;

FIG. 16 is a schematic side elevation view of the apparatus of FIG. 15, according to one or more examples of the present disclosure;

FIG. 17 is a schematic section, side elevation view of the apparatus of FIG. 15, according to one or more examples of the present disclosure;

FIG. 18 is a schematic perspective view of an apparatus of the system of FIG. 1, according to one or more examples of the present disclosure;

FIG. 19 is a first portion of a block diagram of a method of applying a viscous material onto a surface of a workpiece, according to one or more examples of the present disclosure;

FIG. 20 is a block diagram of aircraft production and service methodology; and FIG. 21 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 19 and 20, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 19 and 20 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, any means-plus-function clause is to be interpreted under 35 U.S.C. 112(f), unless otherwise explicitly stated. It should be noted that examples provided herein of any structure, material, or act in support of any means-plus-function clause, and equivalents thereof, may be utilized individually or in combination. Thus, while various structures, materials, or acts may be described in connection with a means-plus-function clause, any combination thereof or of their equivalents is contemplated in support of such means-plus-function clause.

Illustrative, non-exhaustive examples, which may or may not be claimed, of the subject matter according the present disclosure are provided below.

Referring e.g. to FIGS. 1-18, apparatus 102 for applying viscous material 162 to surface 182 of workpiece 180 is disclosed. Apparatus 102 comprises channel 104 comprising inlet 106 and outlet 108. Channel 104 has width CW that increases from inlet 106 to outlet 108. Apparatus 102 also comprises dividers 110 inside channel 104. Channel 104 further comprises subdivisions 112 formed by dividers 110. Subdivisions 112 of channel 104 are in communication with inlet 106 and outlet 108 of channel 104. At least one of subdivisions 112 of channel 104 has width SW that increases from inlet 106 of channel 104 to outlet 108 of channel 104. The preceding subject matter of this paragraph characterizes example 1 of the present disclosure.

Apparatus 102 improves the ease and accuracy of applying a wide layer of viscous material 162 having a uniform thickness onto surface 182 of workpiece 180. More specifically, as viscous material 162 passes through channel 104, dividers 110 evenly distribute viscous material 162 across width CW of channel 104 such that viscous material 162 at outlet 108 of channel 104 has a predetermined width and uniform thickness. Dividers 110 spread viscous material 162 laterally outwardly to uniformly fill width CW of channel 104 as width CW increases. By facilitating the application onto surface 182 of workpiece 180 of a wide layer of viscous material 162 with a uniform thickness, apparatus 102 reduces time, effort, and inconsistency associated with covering relatively large areas of surface 182 of workpiece 180 with viscous material 162. Viscous material 162 can be any of various viscous materials, such as adhesives, sealants, paints, and the like.

Referring generally to FIG. 1 and particularly to e.g. FIGS. 2, 3, and 5-8, channel 104 has volume CV and cross-sectional area CA. Volume CV is adjustable to any one of first volumetric values or any one of second volumetric values. Cross-sectional area CA of channel 104 increases from inlet 106 of channel 104 to outlet 108 of channel 104 when volume CV of channel 104 is held constant at any of at least one of the first volumetric values. Each of subdivisions 112 of channel 104 has volume SV. Volume SV of each of subdivisions 112 is adjustable to any one of third volumetric values. Each of the third volumetric values is less than each of the first volumetric values or each of the second volumetric values. At least one of subdivisions 112 of channel 104 also has cross-sectional area SA that increases from inlet 106 of channel 104 to outlet 108 of channel 104 when volume CV of channel 104 is held constant at any of at least one of the second volumetric values. The preceding subject matter of this paragraph characterizes example 2 of the present disclosure, wherein example 2 includes the subject matter of example 1, above.

Adjustability of volume CV of channel 104 and volume SV of each of subdivisions 112 facilitates adjustment of the thickness of viscous material 162 at outlet 108 of channel 104. Additionally, volume CV of channel 104 and volume SV of each of subdivisions 112 is adjustable to accommodate the use of viscous materials with different viscosities.

Referring generally to FIG. 1 and particularly to e.g. FIGS. 2, 3, and 5-8, the second volumetric values are different from the first volumetric values. The preceding subject matter of this paragraph characterizes example 3 of the present disclosure, wherein example 3 includes the subject matter of example 2, above.

The configuration of dividers 110 and subdivisions 112 may be such that for some volumetric values of volume CV of channel 104, cross-sectional area CA of channel 104 is increasing, while cross-sectional area SA of at least one of subdivisions 112 may not be increasing. In other words, an increasing cross-sectional area CA of channel 104 does not necessarily mean an increasing cross-sectional area SA of all of subdivisions 112.

Referring generally to FIG. 1 and particularly to e.g. FIGS. 2, 3, and 5-8, channel 104 has volume CV and cross-sectional area CA. Volume CV is adjustable to any one of first volumetric values or any one of second volumetric values. Cross-sectional area CA of channel 104 stays constant from inlet 106 of channel 104 to outlet 108 of channel 104 when volume CV of channel 104 is held constant at any of at least one of the first volumetric values. Each of subdivisions 112 of channel 104 has volume SV. Volume SV of each of subdivisions 112 is adjustable to any one of third volumetric values. Each of the third volumetric values is less than each of the first volumetric values or each of the second volumetric values. At least one of subdivisions 112 of channel 104 also has cross-sectional area SA that stays constant from inlet 106 of channel 104 to outlet 108 of channel 104 when volume CV of channel 104 is held constant at any of at least one of the second volumetric values. The preceding subject matter of this paragraph characterizes example 4 of the present disclosure, wherein example 4 includes the subject matter of example 1, above.

Adjustability of volume CV of channel 104 and volume SV of each of subdivisions 112 facilitates adjustment of the thickness of viscous material 162 at outlet 108 of channel 104. Additionally, volume CV of channel 104 and volume SV of each of subdivisions 112 is adjustable to accommodate the use of viscous materials with different viscosities.

Referring generally to FIG. 1 and particularly to e.g. FIGS. 2, 3, and 5-8, the second volumetric values are different from the first volumetric values. The preceding subject matter of this paragraph characterizes example 5 of the present disclosure, wherein example 5 includes the subject matter of example 4, above.

The configuration of dividers 110 and subdivisions 112 may be such that for some volumetric values of volume CV of channel 104, cross-sectional area CA of channel 104 is constant, while cross-sectional area SA of at least one of subdivisions 112 may not be constant. In other words, a constant cross-sectional area CA of channel 104 does not necessarily mean a constant cross-sectional area SA of all of subdivisions 112.

Referring generally to FIG. 1 and particularly to e.g. FIGS. 2, 3, and 5-8, channel 104 has volume CV and cross-sectional area CA. Volume CV is adjustable to any one of first volumetric values or any one of second volumetric values. Cross-sectional area CA of channel 104 decreases from inlet 106 of channel 104 to outlet 108 of channel 104 when volume CV of channel 104 is held constant at any of at least one of the first volumetric values. Each of subdivisions 112 of channel 104 has volume SV. Volume SV of each of subdivisions 112 is adjustable to any one of third volumetric values. Each of the third volumetric values is less than each of the first volumetric values or each of the second volumetric values. At least one of subdivisions 112 of channel 104 also has cross-sectional area SA that decreases from inlet 106 of channel 104 to outlet 108 of channel 104 when volume CV of channel 104 is held constant at any of at least one of the second volumetric values. The preceding subject matter of this paragraph characterizes example 6 of the present disclosure, wherein example 6 includes the subject matter of example 1, above.

Adjustability of volume CV of channel 104 and volume SV of each of subdivisions 112 facilitates adjustment of the thickness of viscous material 162 at outlet 108 of channel 104. Additionally, volume CV of channel 104 and volume SV of each of subdivisions 112 is adjustable to accommodate the use of viscous materials with different viscosities.

Referring generally to FIG. 1 and particularly to e.g. FIGS. 2, 3, and 5-8, the second volumetric values are different from the first volumetric values. The preceding subject matter of this paragraph characterizes example 7 of the present disclosure, wherein example 7 includes the subject matter of example 6, above.

The configuration of dividers 110 and subdivisions 112 may be such that for some volumetric values of volume CV of channel 104, cross-sectional area CA of channel 104 is decreasing, while cross-sectional area SA of at least one of subdivisions 112 may not be decreasing. In other words, a decreasing cross-sectional area CA of channel 104 does not necessarily mean a decreasing cross-sectional area SA of all of subdivisions 112.

Referring generally to FIG. 1 and particularly to e.g. FIGS. 3 and 5-8, dividers 110 are located partially outside channel 104. The preceding subject matter of this paragraph characterizes example 8 of the present disclosure, wherein example 8 includes the subject matter of any of examples 1-7, above.

Locating dividers 110 partially outside channel 104 allows dividers 110 to remain inside channel 104 as volume CV of channel 104 changes. Additionally, locating dividers 110 partially outside channel 104 provides ability to fix dividers 110 independently of channel 104 to facilitate adjustment of volume CV of channel 104 relative to dividers 110.

Referring generally to FIG. 1 and particularly to e.g. FIGS. 2, 3, 5-14, and 18, apparatus 102 further comprises flow regulator 130 at least partially defining channel 104. The preceding subject matter of this paragraph characterizes example 9 of the present disclosure, wherein example 9 includes the subject matter of any of examples 1-8, above.

Flow regulator 130 facilitates the regulation of the flow of viscous material 162 through channel 104. More specifically, the flow of viscous material 162 through channel 104 may be adjusted by adjustment of flow regulator 130. Adjustment of the flow of viscous material 162 through channel 104 facilitates changing the characteristics of layer 164 of viscous material 162 applied to surface 182 of workpiece 180 by apparatus 102.

Referring generally to FIG. 1 and particularly to e.g. FIGS. 2, 3, and 5-8, flow regulator 130 comprises flap 136. The preceding subject matter of this paragraph characterizes example 10 of the present disclosure, wherein example 10 includes the subject matter of example 9, above.

Flap 136 facilitates changing volume CV of channel 104 and cross-sectional area OA of outlet 108. Adjustment of flap 136 may not change width CW of channel 104.

Referring generally to FIG. 1 and particularly to e.g. FIGS. 2, 3, and 5-8, apparatus 102 further comprises wall 126 at least partially defining channel 104. Flap 136 comprises first end 138 coupled to wall 126 at inlet 106 of channel 104 and second end 140 at outlet 108 of channel 104. The preceding subject matter of this paragraph characterizes example 11 of the present disclosure, wherein example 11 includes the subject matter of example 10, above.

By extending from first end 138 at inlet 106 of channel 104 to second end 140 at outlet 108 of channel 104, flap 136 defines a portion of channel 104 extending from first end 138 to second end 140. In this manner, adjustment of flap 136 changes cross-sectional area of channel 104 at each location of channel 104 between inlet 106 and outlet 108 of channel. Additionally, with second end 140 of flap 136 at outlet 108 of channel 104, flap 136 at least partially defines outlet 108 of channel 104. Accordingly, adjustment of flap 136 correspondingly changes cross-sectional area OA of outlet 108.

Referring generally to FIG. 1 and particularly to e.g. FIGS. 2, 3, and 5-8, first end 138 of flap 136 is hinged to wall 126 of channel 104. The preceding subject matter of this paragraph characterizes example 12 of the present disclosure, wherein example 12 includes the subject matter of example 11, above.

Hinging first end 138 of flap 136 to wall 126 of channel 104 facilitates adjustment of flap 136 relative to wall 126. Flap 136 may rotate about hinged connection between flap 136 and wall 126. Further, the hinged connection between flap 136 and wall 126 at inlet 106 of channel 104 may facilitate adjustment of cross-sectional area OA of outlet 108 of channel while holding constant a cross-sectional area of inlet 106 of channel 104.

Referring generally to FIG. 1 and particularly to e.g. FIGS. 2, 3, and 5-8, apparatus 102 further comprises actuator 144 coupled to flap 136. Actuator 144 is configured to move at least a portion of flap 136 relative to dividers 110. The preceding subject matter of this paragraph characterizes example 13 of the present disclosure, wherein example 13 includes the subject matter of any of examples 11 or 12, above.

Actuator 144 is actuatable to induce movement of flap 136. Moving at least a portion of flap 136 relative to dividers 110 provides ability to fix dividers 110 independently of channel 104 to facilitate adjustment of volume CV of channel 104 relative to dividers 110.

Referring generally to FIG. 1 and particularly to e.g. FIGS. 2, 3, and 5-8, actuator 144 comprises riser 146 fixed to flap 136. Actuator 144 also comprises knob 148 movably engaging riser 146. Wall 126 is interposed between flap 136 and knob 148 and comprises opening 128 through which riser 146 extends. Knob 148 is movable relative to riser 146 for exerting equal and opposite forces on riser 146 and wall 126 to move riser 146 and flap 136 relative to dividers 110. Riser 146 is configured to move through opening 128 in wall 126. The preceding subject matter of this paragraph characterizes example 14 of the present disclosure, wherein example 14 includes the subject matter of example 13, above.

Flap 136 is movable relative to dividers 110 by moving knob 148 relative to riser 146. Knob 148 can be rotated in one direction to move flap 136 in a first direction and rotated in another direction to move flap 136 in a second direction opposite the first direction. The first direction may be associated with increasing volume CV and cross-sectional area CA of channel 104. The second direction may be associated with decreasing volume CV and cross-sectional area CA of channel 104. Riser 146 may be an externally threaded rod and knob 148 may be an internally threaded nut threadably engaged with the threaded rod in one embodiment.

Figure 2:
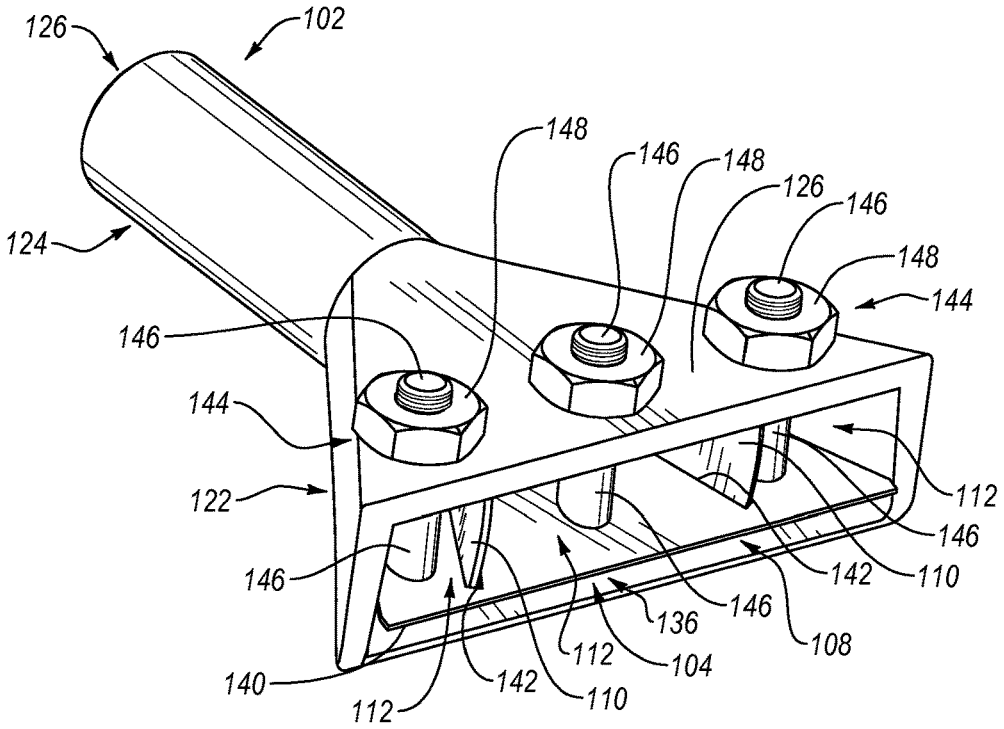
Figure 3:
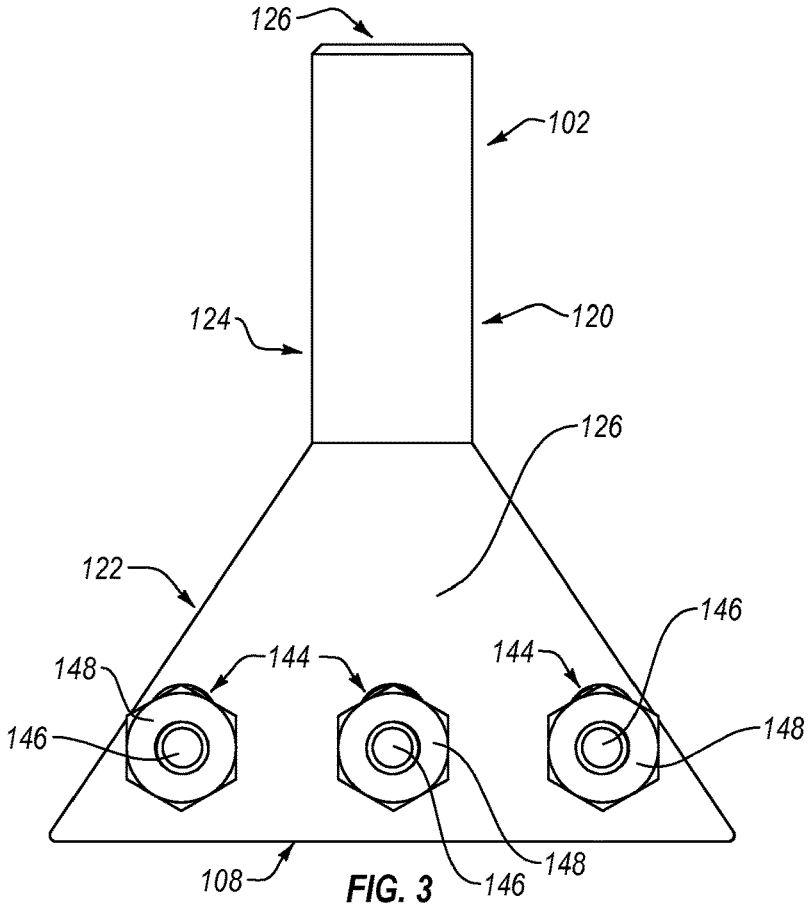
Figure 4:
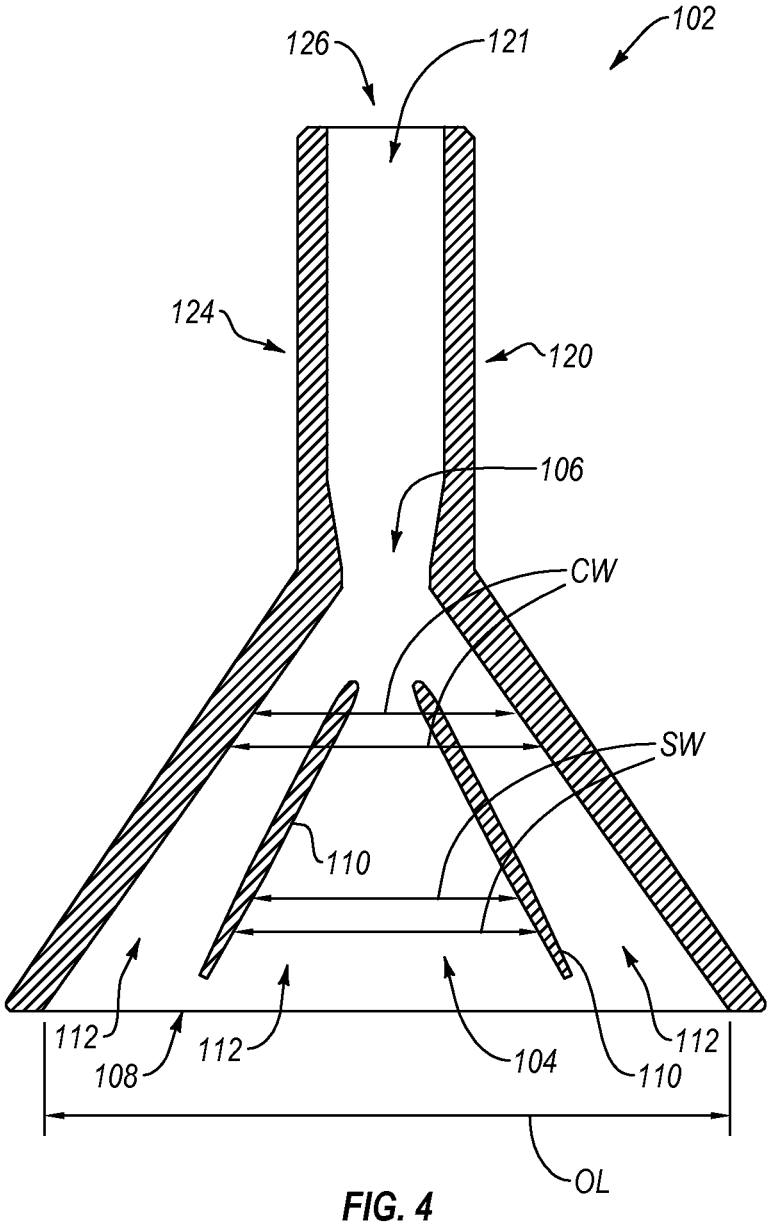
Figure 5:
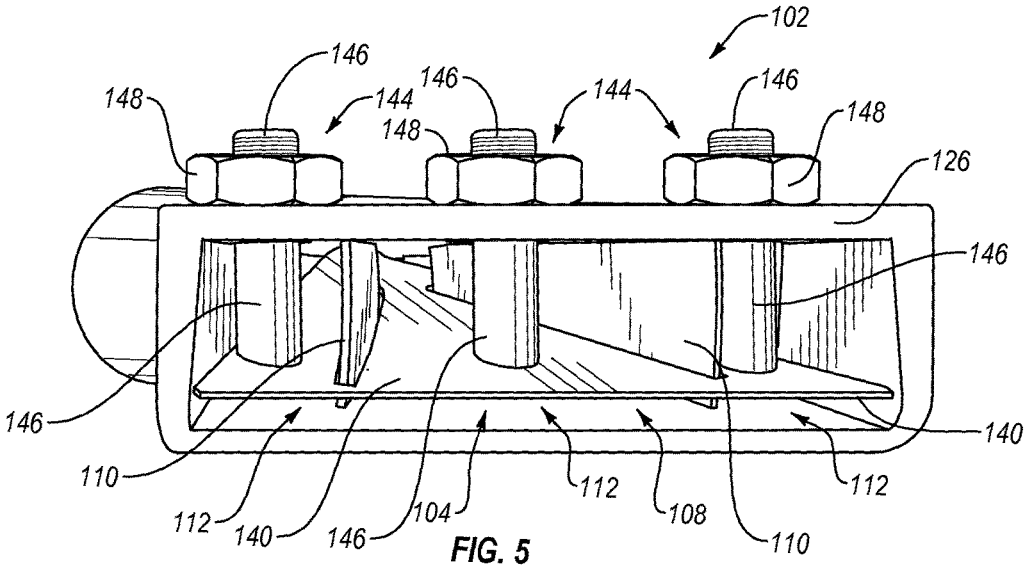
Figure 6:
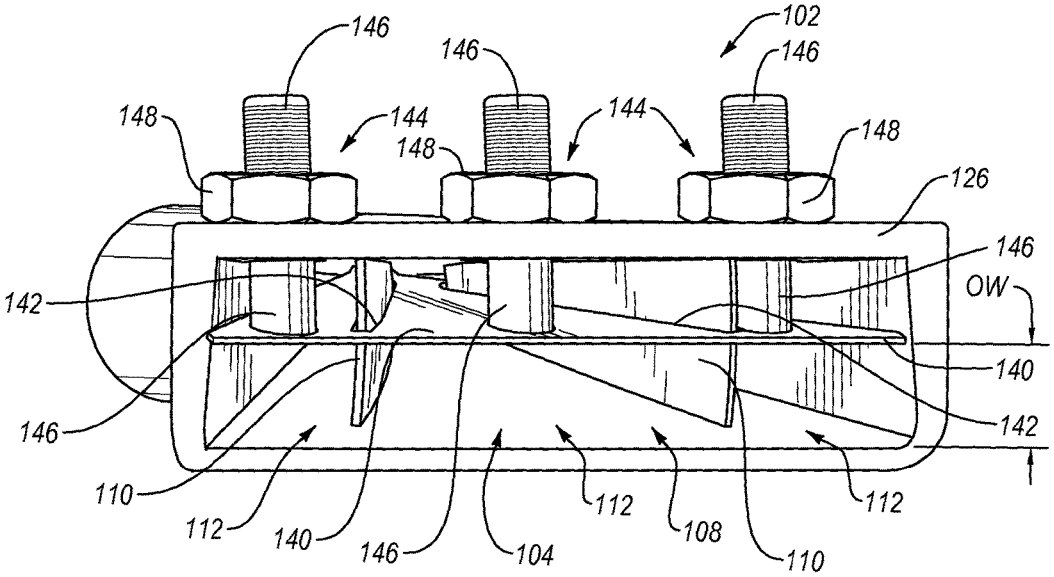
Figure 7:
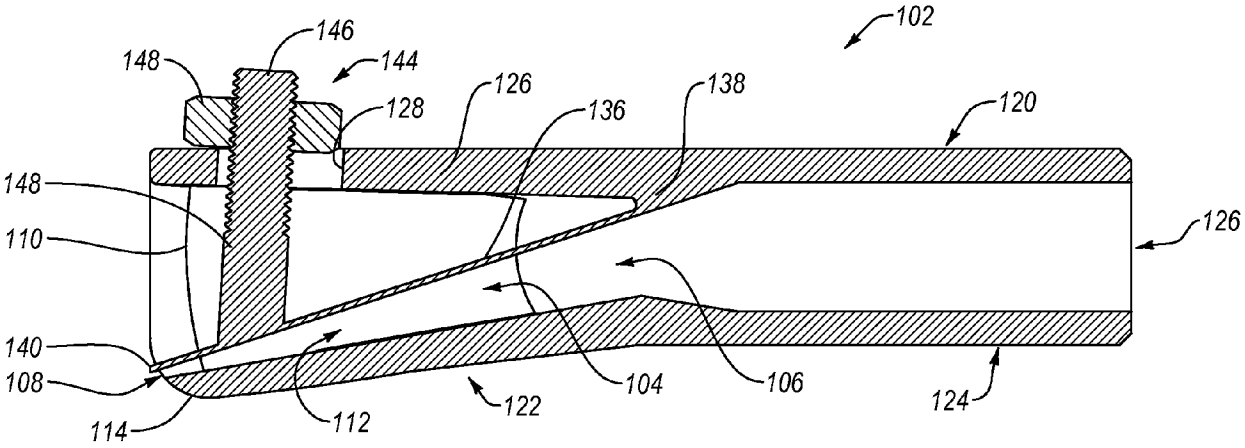
Figure 8:
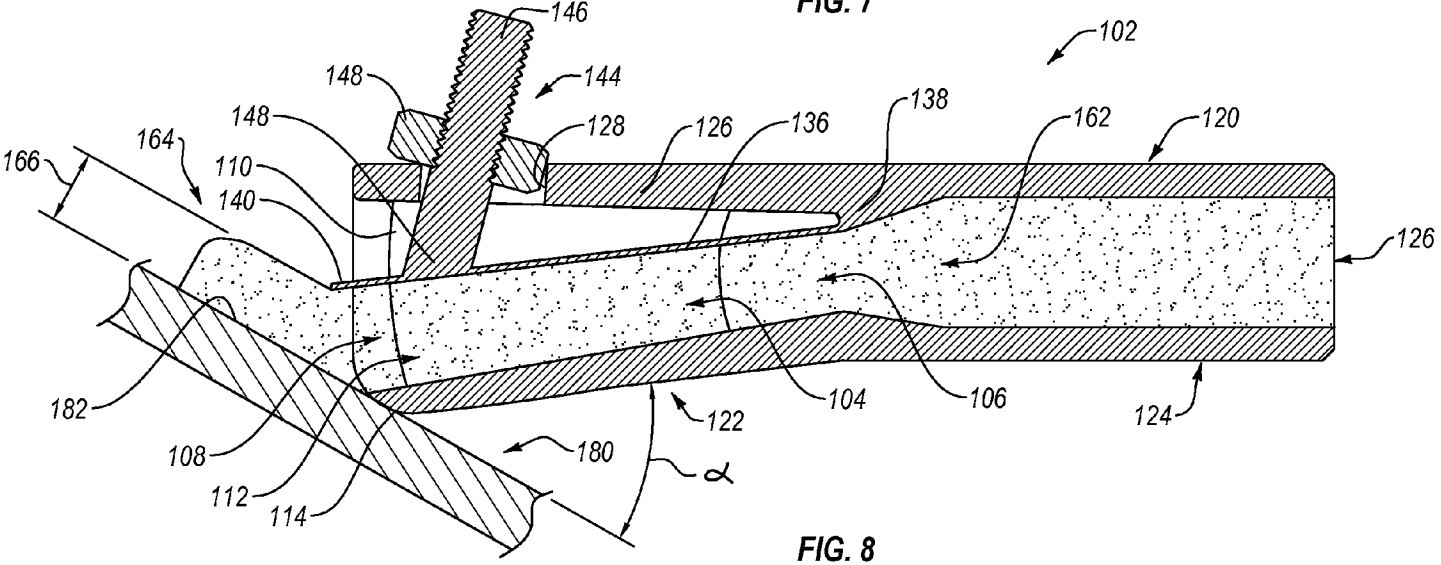

Referring generally to FIG. 1 and particularly to e.g. FIGS. 2, 5, and 6, flap 136 comprises slots 142. Each divider 110 passes through a respective one of slots 142. The preceding subject matter of this paragraph characterizes example 15 of the present disclosure, wherein example 15 includes the subject matter of any of examples 10-14, above.

Passing each divider 110 through a respective one of slots 142 of flap 136 provides ability to fix dividers 110 independently of flap 136 to facilitate adjustment of volume CV of channel 104 relative to dividers 110. The size and shape of slots 142 may complement size and shape of dividers 110 to inhibit flow of viscous material 162 between respective slots 142 and dividers 110 and retain viscous material 162 in channel 104.

Referring generally to FIG. 1 and particularly to e.g. FIGS. 2, 3, 5, and 6, flap 136 has width FW equal to width CW of channel 104 at corresponding locations between inlet 106 and outlet 108 of channel 104. The preceding subject matter of this paragraph characterizes example 16 of the present disclosure, wherein example 16 includes the subject matter of any of examples 10-15, above.

Width FW of flap 136 being equal to width CW of channel 104 allows flap 136 to define an entire side of channel 104. In this manner, adjustment of flap 136 may result in a uniform change in a height of channel 104 across width CW of channel 104.

Referring generally to FIG. 1 and particularly to e.g. FIGS. 2, 3, 5-14, and 18, outlet 108 of channel 104 has area OA that is adjustable. The preceding subject matter of this paragraph characterizes example 17 of the present disclosure, wherein example 17 includes the subject matter of any of examples 1-16, above.

Adjustability of area OA of outlet 108 of channel 104 facilitates adjustment of the thickness of viscous material 162 at outlet 108 of channel 104. The thickness of viscous material 162 at outlet 108 of channel 104 may control thickness 166 of layer 164 of viscous material 162 applied onto surface 182 of workpiece 180.

Referring generally to FIG. 1 and particularly to e.g. FIGS. 2, 3, 5-14, and 18, apparatus 102 further comprises flow regulator 130 at least partially defining channel 104. Outlet 108 of channel 104 has area OA that is adjustable. The preceding subject matter of this paragraph characterizes example 18 of the present disclosure, wherein example 18 includes the subject matter of example 1, above.

Flow regulator 130 facilitates the regulation of the flow of viscous material 162 through channel 104. More specifically, the flow of viscous material 162 through channel 104 may be adjusted by adjustment of flow regulator 130. Adjustment of the flow of viscous material 162 through channel 104 facilitates changing the characteristics of layer 164 of viscous material 162 applied to surface 182 of workpiece 180 by apparatus 102. Adjustability of area OA of outlet 108 of channel 104 facilitates adjustment of the thickness of viscous material 162 at outlet 108 of channel 104. The thickness of viscous material 162 at outlet 108 of channel 104 may control thickness 166 of layer 164 of viscous material 162 applied onto surface 182 of workpiece 180.

Referring generally to FIG. 1 and particularly to e.g. FIGS. 9-14 and 18, channel 104 has volume CV that is constant. Each of subdivisions 112 has volume SV that is constant. The preceding subject matter of this paragraph characterizes example 19 of the present disclosure, wherein example 19 includes the subject matter of example 18, above.

Characteristics of layer 164 of viscous material 162 applied to surface 182 of workpiece 180 may be changed by holding volume CV of channel 104 and volume SV of subdivisions constant, while adjusting area OA of outlet 108 of channel 104.

Referring generally to FIG. 1 and particularly to e.g. FIGS. 9-14 and 18, apparatus 102 further comprises wall 126 at least partially defining channel 104. Flow regulator 130 comprises gate 150 at outlet 108. Gate 150 is movable relative to wall 126 to adjust area OA of outlet 108. The preceding subject matter of this paragraph characterizes example 20 of the present disclosure, wherein example 20 includes the subject matter of example 19, above.

Gate 150 facilitates changing cross-sectional area OA of outlet 108. Movement of gate 150 relative to wall 126 may not change width CW or volume CV of channel 104. Area OA of outlet 108 may be adjusted by sliding gate 150 relative to wall 126. Apparatus 102 may include body 120 with grooves 152. Gate 150 may include tongues 156 each configured to complement a respective one of grooves 152. Engagement between respective grooves 152 of body 120 and tongues of gate 150 facilitate movable coupling between gate 150 and body 120. In some embodiments, gate 150 may include grooves 152 and body 120 may include tongues. Coupling arrangements other than tongue-and-groove, such as rack-and-pinion systems, may be used.

Referring generally to FIG. 1 and particularly to e.g. FIGS. 9-12, apparatus 102 further includes means 154 for selectively securing gate 150 in different positions relative to wall 126 to adjust area OA of outlet 108. The preceding subject matter of this paragraph characterizes example 21 of the present disclosure, wherein example 21 includes the subject matter of example 20, above.

Means 154 facilitates ease in temporarily fixing a position of gate 150 relative to wall 126, and thus area OA of outlet 108. More specifically, means 154 is adjustable to either allow or prevent relative movement between gate 150 and wall 126. Means 154 can be at least one set screw that passes through wall 126 and is tightenable against gate 150 to temporarily fix a position of gate 150 relative to wall 126. Means 154 can include other coupling arrangements, such as, but not limited to, pins, clips, locks, interference fits, and the like, that facilitate temporarily fixing a position of gate 150 relative to wall 126.

Referring generally to FIG. 1 and particularly to e.g. FIGS. 7-9 and 12-18, apparatus 102 further comprises curved leading surface 114 extending from outlet 108. The preceding subject matter of this paragraph characterizes example 22 of the present disclosure, wherein example 22 includes the subject matter of any of examples 1-21, above.

Curved leading surface 114 facilitates ease in moving apparatus 102 along surface 182 of workpiece 180 while apparatus 102 applies viscous material 162 to surface 182 of workpiece 180. Additionally, curved leading surface 114 promotes ease in adjusting an orientation of apparatus 102 relative to surface 182 of workpiece 180. Adjustment of the orientation of apparatus 102 relative to surface 182 may be accomplished by rotating apparatus 102 relative to surface 182 about curved leading surface 114 while curved leading surface is in contact with surface 182. Adjusting the orientation of apparatus 102 relative to surface 182 in this manner may change thickness 166 of layer 164 of viscous material 162 applied onto surface 182.

Referring generally to FIG. 1 and particularly to e.g. FIGS. 7-9 and 12-18, curved leading surface 114 has a constant radius of curvature. The preceding subject matter of this paragraph characterizes example 23 of the present disclosure, wherein example 23 includes the subject matter of example 22, above.

Constant radius of curvature of curved leading surface 114 promotes predictability and uniformity of the change in orientation of apparatus 102 relative to surface 182 as apparatus 102 is rotated relative to surface 182 about curved leading surface 114.

Referring generally to FIG. 1 and particularly to e.g. FIG. 18, apparatus 102 further comprises at least one standoff 190 outside channel 104. Standoff 190 protrudes distance D from outlet 108. The preceding subject matter of this paragraph characterizes example 24 of the present disclosure, wherein example 24 includes the subject matter of any of examples 1-23, above.

Standoffs 190 promote placement of apparatus 102 in a predetermined position relative to surface 182 of workpiece 180. More specifically, contact between standoffs 190 and surface 182 of workpiece 180 ensures outlet 108 of channel 104 is predetermined distance D away from surface 182 of workpiece 180. Apparatus 102 includes at least one standoff 190. In some embodiments, apparatus 102 includes at least two standoffs 190. In yet some embodiments, apparatus 102 includes at least four standoffs 190. Standoffs 190 may include features, such as wheels, curved smooth surfaces, and the like, that facilitate moving apparatus 102 along surface 182.

Referring e.g. to FIGS. 1-18, system 100 for applying viscous material 162 to surface 182 of workpiece 180 is disclosed. System 100 comprises channel 104 comprising inlet 106 and outlet 108. Channel 104 has width CW that increases from inlet 106 to outlet 108. System 100 also comprises dividers 110 inside channel 104. Channel 104 further comprises subdivisions 112 formed by dividers 110. Subdivisions 112 of channel 104 are in communication with inlet 106 and outlet 108 of channel 104. At least one of subdivisions 112 of channel 104 has width SW that increases from inlet 106 of channel 104 to outlet 108 of channel 104. System 100 further comprises material supply device 160 coupled to channel 104. Material supply device 160 is configured to supply viscous material 162 to channel 104. The preceding subject matter of this paragraph characterizes example 25 of the present disclosure.

System 100 improves the ease and accuracy of applying a wide layer of viscous material 162 having a uniform thickness onto surface 182 of workpiece 180. More specifically, as viscous material 162 passes through channel 104, dividers 110 evenly distribute viscous material 162 across width CW of channel 104 such that viscous material 162 at outlet 108 of channel 104 has a predetermined width and uniform thickness. Dividers 110 spread viscous material 162 laterally outwardly to uniformly fill width CW of channel 104 as width CW increases. By facilitating the application onto surface 182 of workpiece 180 of a wide layer of viscous material 162 with a uniform thickness, system 100 reduces time, effort, and inconsistency associated with covering relatively large areas of surface 182 of workpiece 180 with viscous material 162. Material supply device 160 promotes the supply of viscous material 162 to channel 104. More specifically, material supply device 160 can be a manual device, such as a sealant tube dispenser or gun, for manually pumping viscous material 162 into channel 104. Alternatively, material supply device 160 can be an automated device for automatically pumping viscous material 162 into channel 104. Material supply device 160 may interface with channel 104 via receiver portion 124 of apparatus 102. Receiver portion 124 may include attachment interface 126 that interfaces with a portion of material supply device 160.

Referring generally to FIG. 1, system 100 further comprises end effector 174 co-movably coupled to channel 104. The preceding subject matter of this paragraph characterizes example 26 of the present disclosure, wherein example 26 includes the subject matter of example 25, above.

End effector 174 promotes the use of system 100 in an automated process for applying viscous material 162 to surface 182 of workpiece 180. More specifically, end effector 174 may increase speed and precision when applying viscous material 162 to surface 182.

Referring generally to FIG. 1, system 100 further comprises controller 172 operably coupled to end effector 174 to autonomously control movement of end effector 174 and channel 104. The preceding subject matter of this paragraph characterizes example 27 of the present disclosure, wherein example 27 includes the subject matter of example 26, above.

Controller 172 also promotes the use of system 100 in an automated process for applying viscous material 162 to surface 182 of workpiece 180. More specifically, controller 172 may be programmed to control movement of end effector 174 relative to surface 182, and the flow of viscous material 162 into channel 104.

Referring generally to FIG. 1 and particularly to e.g. FIGS. 2, 3, and 5-8, channel 104 has volume CV and cross-sectional area CA. Volume CV is adjustable to any one of first volumetric values or any one of second volumetric values. Cross-sectional area CA of channel 104 increases from inlet 106 of channel 104 to outlet 108 of channel 104 when volume CV of channel 104 is held constant at any of at least one of the first volumetric values. Each of subdivisions 112 of channel 104 has volume SV. Volume SV of each of subdivisions 112 is adjustable to any one of third volumetric values. Each of the third volumetric values is less than each of the first volumetric values or each of the second volumetric values. At least one of subdivisions 112 of channel 104 also has cross-sectional area SA that increases from inlet 106 of channel 104 to outlet 108 of channel 104 when volume CV of channel 104 is held constant at any of at least one of the second volumetric values. The preceding subject matter of this paragraph characterizes example 28 of the present disclosure, wherein example 28 includes the subject matter of any of examples 25-27, above.

Adjustability of volume CV of channel 104 and volume SV of each of subdivisions 112 facilitates adjustment of the thickness of viscous material 162 at outlet 108 of channel 104. Additionally, volume CV of channel 104 and volume SV of each of subdivisions 112 is adjustable to accommodate the use of viscous materials with different viscosities.

Referring generally to FIG. 1 and particularly to e.g. FIGS. 2, 3, and 5-8, the second volumetric values are different from the first volumetric values. The preceding subject matter of this paragraph characterizes example 29 of the present disclosure, wherein example 29 includes the subject matter of example 28, above.

The configuration of dividers 110 and subdivisions 112 may be such that for some volumetric values of volume CV of channel 104, cross-sectional area CA of channel 104 is increasing, while cross-sectional area SA of at least one of subdivisions 112 may not be increasing. In other words, an increasing cross-sectional area CA of channel 104 does not necessarily mean an increasing cross-sectional area SA of all of subdivisions 112.

Referring generally to FIG. 1 and particularly to e.g. FIGS. 2, 3, and 5-8, channel 104 has volume CV and cross-sectional area CA. Volume CV is adjustable to any one of first volumetric values or any one of second volumetric values. Cross-sectional area CA of channel 104 stays constant from inlet 106 of channel 104 to outlet 108 of channel 104 when volume CV of channel 104 is held constant at any of at least one of the first volumetric values. Each of subdivisions 112 of channel 104 has volume SV. Volume SV of each of subdivisions 112 is adjustable to any one of third volumetric values. Each of the third volumetric values is less than each of the first volumetric values or each of the second volumetric values. At least one of subdivisions 112 of channel 104 also has cross-sectional area SA that stays constant from inlet 106 of channel 104 to outlet 108 of channel 104 when volume CV of channel 104 is held constant at any of at least one of the second volumetric values. The preceding subject matter of this paragraph characterizes example 30 of the present disclosure, wherein example 30 includes the subject matter of any of examples 25-27, above.

Adjustability of volume CV of channel 104 and volume SV of each of subdivisions 112 facilitates adjustment of the thickness of viscous material 162 at outlet 108 of channel 104. Additionally, volume CV of channel 104 and volume SV of each of subdivisions 112 is adjustable to accommodate the use of viscous materials with different viscosities.

Referring generally to FIG. 1 and particularly to e.g. FIGS. 2, 3, and 5-8, the second volumetric values are different from the first volumetric values. The preceding subject matter of this paragraph characterizes example 31 of the present disclosure, wherein example 31 includes the subject matter of example 30, above.

The configuration of dividers 110 and subdivisions 112 may be such that for some volumetric values of volume CV of channel 104, cross-sectional area CA of channel 104 is constant, while cross-sectional area SA of at least one of subdivisions 112 may not be constant. In other words, a constant cross-sectional area CA of channel 104 does not necessarily mean a constant cross-sectional area SA of all of subdivisions 112.

Referring generally to FIG. 1 and particularly to e.g. FIGS. 2, 3, and 5-8, channel 104 has volume CV and cross-sectional area CA. Volume CV is adjustable to any one of first volumetric values or any one of second volumetric values. Cross-sectional area CA of channel 104 decreases from inlet 106 of channel 104 to outlet 108 of channel 104 when volume CV of channel 104 is held constant at any of at least one of the first volumetric values. Each of subdivisions 112 of channel 104 has volume SV. Volume SV of each of subdivisions 112 is adjustable to any one of third volumetric values. Each of the third volumetric values is less than each of the first volumetric values or each of the second volumetric values. At least one of subdivisions 112 of channel 104 also has cross-sectional area SA that decreases from inlet 106 of channel 104 to outlet 108 of channel 104 when volume CV of channel 104 is held constant at any of at least one of the second volumetric values. The preceding subject matter of this paragraph characterizes example 32 of the present disclosure, wherein example 32 includes the subject matter of any of examples 25-27, above.

Adjustability of volume CV of channel 104 and volume SV of each of subdivisions 112 facilitates adjustment of the thickness of viscous material 162 at outlet 108 of channel 104. Additionally, volume CV of channel 104 and volume SV of each of subdivisions 112 is adjustable to accommodate the use of viscous materials with different viscosities.

Referring generally to FIG. 1 and particularly to e.g. FIGS. 2, 3, and 5-8, the second volumetric values are different from the first volumetric values. The preceding subject matter of this paragraph characterizes example 33 of the present disclosure, wherein example 33 includes the subject matter of example 32, above.

The configuration of dividers 110 and subdivisions 112 may be such that for some volumetric values of volume CV of channel 104, cross-sectional area CA of channel 104 is decreasing, while cross-sectional area SA of at least one of subdivisions 112 may not be decreasing. In other words, a decreasing cross-sectional area CA of channel 104 does not necessarily mean a decreasing cross-sectional area SA of all of subdivisions 112.

Referring generally to FIG. 1 and particularly to e.g. FIGS. 3 and 5-8, system 100 according to any of claims 25-33, dividers 110 are located partially outside channel 104. The preceding subject matter of this paragraph characterizes example 34 of the present disclosure, wherein example 34 includes the subject matter of any of examples 25-33, above.

Locating dividers 110 partially outside channel 104 allows dividers 110 to remain inside channel 104 as volume CV of channel 104 changes. Additionally, locating dividers 110 partially outside channel 104 provides ability to fix dividers 110 independently of channel 104 to facilitate adjustment of volume CV of channel 104 relative to dividers 110.

Referring generally to FIG. 1 and particularly to e.g. FIGS. 2, 3, 5-14, and 18, system 100 further comprises flow regulator 130 at least partially defining channel 104. The preceding subject matter of this paragraph characterizes example 35 of the present disclosure, wherein example 35 includes the subject matter of any of examples 25-34, above.

Flow regulator 130 facilitates the regulation of the flow of viscous material 162 through channel 104. More specifically, the flow of viscous material 162 through channel 104 may be adjusted by adjustment of flow regulator 130. Adjustment of the flow of viscous material 162 through channel 104 facilitates changing the characteristics of layer 164 of viscous material 162 applied to surface 182 of workpiece 180 by system 100.

Referring generally to FIG. 1 and particularly to e.g. FIGS. 2, 3, and 5-8, flow regulator 130 comprises flap 136. The preceding subject matter of this paragraph characterizes example 36 of the present disclosure, wherein example 36 includes the subject matter of example 35, above.

Flap 136 facilitates changing volume CV of channel 104 and cross-sectional area OA of outlet 108. Adjustment of flap 136 may not change width CW of channel 104.

Referring generally to FIG. 1 and particularly to e.g. FIGS. 2, 3, and 5-8, system 100 further comprises wall 126 at least partially defining channel 104. Flap 136 comprises first end 138 coupled to wall 126 at inlet 106 of channel 104 and second end 140 at outlet 108 of channel 104. The preceding subject matter of this paragraph characterizes example 37 of the present disclosure, wherein example 37 includes the subject matter of example 36, above.

By extending from first end 138 at inlet 106 of channel 104 to second end 140 at outlet 108 of channel 104, flap 136 defines a portion of channel 104 extending from first end 138 to second end 140. In this manner, adjustment of flap 136 changes cross-sectional area of channel 104 at each location of channel 104 between inlet 106 and outlet 108 of channel. Additionally, with second end 140 of flap 136 at outlet 108 of channel 104, flap 136 at least partially defines outlet 108 of channel 104. Accordingly, adjustment of flap 136 correspondingly changes cross-sectional area OA of outlet 108.

Referring generally to FIG. 1 and particularly to e.g. FIGS. 2, 3, and 5-8, first end 138 of flap 136 is hinged to wall 126 of channel 104. The preceding subject matter of this paragraph characterizes example 38 of the present disclosure, wherein example 38 includes the subject matter of example 37, above.

Hinging first end 138 of flap 136 to wall 126 of channel 104 facilitates adjustment of flap 136 relative to wall 126. Flap 136 may rotate about hinged connection between flap 136 and wall 126. Further, the hinged connection between flap 136 and wall 126 at inlet 106 of channel 104 may facilitate adjustment of cross-sectional area OA of outlet 108 of channel while holding constant a cross-sectional area of inlet 106 of channel 104.

Referring generally to FIG. 1 and particularly to e.g. FIGS. 2, 3, and 5-8, system 100 further comprises actuator 144 coupled to flap 136. Actuator 144 is configured to move at least a portion of flap 136 relative to dividers 110. The preceding subject matter of this paragraph characterizes example 39 of the present disclosure, wherein example 39 includes the subject matter of any of examples 37 or 38, above.

Actuator 144 is actuatable to induce movement of flap 136. Moving at least a portion of flap 136 relative to dividers 110 provides ability to fix dividers 110 independently of channel 104 to facilitate adjustment of volume CV of channel 104 relative to dividers 110.

Referring generally to FIG. 1 and particularly to e.g. FIGS. 2, 3, and 5-8, actuator 144 comprises riser 146 fixed to flap 136. Actuator 144 also comprises knob 148 movably engaging riser 146. Wall 126 is interposed between flap 136 and knob 148 and comprises opening 128 through which riser 146 extends. Knob 148 is movable relative to riser 146 for exerting equal and opposite forces on riser 146 and wall 126 to move riser 146 and flap 136 relative to dividers 110. Riser 146 is configured to move through opening 128 in wall 126. The preceding subject matter of this paragraph characterizes example 40 of the present disclosure, wherein example 40 includes the subject matter of example 39, above.

Flap 136 is movable relative to dividers 110 by moving knob 148 relative to riser 146. Knob 148 can be rotated in one direction to move flap 136 in a first direction and rotated in another direction to move flap 136 in a second direction opposite the first direction. The first direction may be associated with increasing volume CV and cross-sectional area CA of channel 104. The second direction may be associated with decreasing volume CV and cross-sectional area CA of channel 104. Riser 146 may be an externally threaded rod and knob 148 may be an internally threaded nut threadably engaged with the threaded rod in one embodiment.

Referring generally to FIG. 1 and particularly to e.g. FIGS. 2, 5, and 6, flap 136 comprises slots 142. Each divider 110 passes through a respective one of slots 142. The preceding subject matter of this paragraph characterizes example 41 of the present disclosure, wherein example 41 includes the subject matter of any of examples 36-40, above.

Passing each divider 110 through a respective one of slots 142 of flap 136 provides ability to fix dividers 110 independently of flap 136 to facilitate adjustment of volume CV of channel 104 relative to dividers 110. The size and shape of slots 142 may complement size and shape of dividers 110 to inhibit flow of viscous material 162 between respective slots 142 and dividers 110 and retain viscous material 162 in channel 104.

Referring generally to FIG. 1 and particularly to e.g. FIGS. 2, 3, 5, and 6, flap 136 has width FW equal to width CW of channel 104 at corresponding locations between inlet 106 and outlet 108 of channel 104. The preceding subject matter of this paragraph characterizes example 42 of the present disclosure, wherein example 42 includes the subject matter of any of examples 36-41, above.

Width FW of flap 136 being equal to width CW of channel 104 allows flap 136 to define an entire side of channel 104. In this manner, adjustment of flap 136 may result in a uniform change in a height of channel 104 across width CW of channel 104.

Referring generally to FIG. 1 and particularly to e.g. FIGS. 2, 3, 5-14, and 18, outlet 108 of channel 104 has area OA that is adjustable. The preceding subject matter of this paragraph characterizes example 43 of the present disclosure, wherein example 43 includes the subject matter of any of examples 25-42, above.

Adjustability of area OA of outlet 108 of channel 104 facilitates adjustment of the thickness of viscous material 162 at outlet 108 of channel 104. The thickness of viscous material 162 at outlet 108 of channel 104 may control thickness 166 of layer 164 of viscous material 162 applied onto surface 182 of workpiece 180.

Referring generally to FIG. 1 and particularly to e.g. FIGS. 2, 3, 5-14, and 18, system 100 further comprises flow regulator 130 at least partially defining channel 104. Outlet 108 of channel 104 has area OA that is adjustable. The preceding subject matter of this paragraph characterizes example 44 of the present disclosure, wherein example 44 includes the subject matter of example 25, above.

Flow regulator 130 facilitates the regulation of the flow of viscous material 162 through channel 104. More specifically, the flow of viscous material 162 through channel 104 may be adjusted by adjustment of flow regulator 130. Adjustment of the flow of viscous material 162 through channel 104 facilitates changing the characteristics of layer 164 of viscous material 162 applied to surface 182 of workpiece 180 by system 100. Adjustability of area OA of outlet 108 of channel 104 facilitates adjustment of the thickness of viscous material 162 at outlet 108 of channel 104. The thickness of viscous material 162 at outlet 108 of channel 104 may control thickness 166 of layer 164 of viscous material 162 applied onto surface 182 of workpiece 180.

Referring generally to FIG. 1 and particularly to e.g. FIGS. 9-14 and 18, channel 104 has volume CV that is constant. Each of subdivisions 112 has volume SV that is constant. The preceding subject matter of this paragraph characterizes example 45 of the present disclosure, wherein example 45 includes the subject matter of example 44, above.

Characteristics of layer 164 of viscous material 162 applied to surface 182 of workpiece 180 may be changed by holding volume CV of channel 104 and volume SV of subdivisions constant, while adjusting area OA of outlet 108 of channel 104.

Referring generally to FIG. 1 and particularly to e.g. FIGS. 9-14 and 18, system 100 further comprises wall 126 at least partially defining channel 104. Flow regulator 130 comprises gate 150 at outlet 108. Gate 150 is movable relative to wall 126 to adjust area OA of outlet 108. The preceding subject matter of this paragraph characterizes example 46 of the present disclosure, wherein example 46 includes the subject matter of example 45, above.

Gate 150 facilitates changing cross-sectional area OA of outlet 108. Movement of gate 150 relative to wall 126 may not change width CW or volume CV of channel 104. Area OA of outlet 108 may be adjusted by sliding gate 150 relative to wall 126. System 102 may include body 120 with grooves 152. Gate 150 may include tongues 156 each configured to complement a respective one of grooves 152. Engagement between respective grooves 152 of body 120 and tongues of gate 150 facilitate movable coupling between gate 150 and body 120. In some embodiments, gate 150 may include grooves 152 and body 120 may include tongues. Coupling arrangements other than tongue-and-groove, such as rack-and-pinion systems, may be used.

Referring generally to FIG. 1 and particularly to e.g. FIGS. 9-12, system 100 further comprises means 154 for selectively securing gate 150 in different positions relative to wall 126 to adjust area OA of outlet 108. The preceding subject matter of this paragraph characterizes example 47 of the present disclosure, wherein example 47 includes the subject matter of example 46, above.

Means 154 facilitates ease in temporarily fixing a position of gate 150 relative to wall 126, and thus area OA of outlet 108. More specifically, means 154 is adjustable to either allow or prevent relative movement between gate 150 and wall 126. Means 154 can be at least one set screw that passes through wall 126 and is tightenable against gate 150 to temporarily fix a position of gate 150 relative to wall 126. Means 154 can include other coupling arrangements, such as, but not limited to, pins, clips, locks, interference fits, and the like, that facilitate temporarily fixing a position of gate 150 relative to wall 126.

Referring generally to FIG. 1 and particularly to e.g. FIGS. 7-9 and 12-18, system 100 further comprises curved leading surface 114 extending from outlet 108. The preceding subject matter of this paragraph characterizes example 48 of the present disclosure, wherein example 48 includes the subject matter of any of examples 25-47, above.

Curved leading surface 114 facilitates ease in moving system 100 along surface 182 of workpiece 180 while system 100 applies viscous material 162 to surface 182 of workpiece 180. Additionally, curved leading surface 114 promotes ease in adjusting an orientation of channel 104 relative to surface 182 of workpiece 180. Adjustment of the orientation of channel 104 relative to surface 182 may be accomplished by rotating channel 104 relative to surface 182 about curved leading surface 114 while curved leading surface is in contact with surface 182. Adjusting the orientation of channel 104 relative to surface 182 in this manner may change thickness 166 of layer 164 of viscous material 162 applied onto surface 182.

Referring generally to FIG. 1 and particularly to e.g. FIGS. 7-9 and 12-18, curved leading surface 114 has a constant radius of curvature. The preceding subject matter of this paragraph characterizes example 49 of the present disclosure, wherein example 49 includes the subject matter of example 48, above.

Constant radius of curvature of curved leading surface 114 promotes predictability and uniformity of the change in orientation of channel 104 relative to surface 182 as channel 104 is rotated relative to surface 182 about curved leading surface 114.

Referring generally to FIG. 1 and particularly to e.g. FIG. 18, system 100 further comprises at least one standoff 190 outside channel 104. Standoff 190 protrudes distance D from outlet 108. The preceding subject matter of this paragraph characterizes example 50 of the present disclosure, wherein example 50 includes the subject matter of any of examples 25-49, above.

Standoffs 190 promote placement of system 100 in a predetermined position relative to surface 182 of workpiece 180. More specifically, contact between standoffs 190 and surface 182 of workpiece 180 ensures outlet 108 of channel 104 is predetermined distance D away from surface 182 of workpiece 180. System 100 includes at least one standoff 190. In some embodiments, system 100 includes at least two standoffs 190. In yet some embodiments, system 100 includes at least four standoffs 190. Standoffs 190 may include features, such as wheels, curved smooth surfaces, and the like, that facilitate moving system 100 along surface 182.

Referring generally to e.g. FIGS. 1-18, and particularly to FIG. 19A (blocks 202-206), method 200 of applying viscous material 162 onto surface 182 of workpiece 180 as layer 164 having thickness 166 is disclosed. Method 200 comprises establishing contact between apparatus 102 and surface 182 of workpiece 180 at angle α. Apparatus 102 comprises channel 104 comprising inlet 106 and outlet 108. Channel 104 comprises width CW that increases from inlet 106 of channel 104 to outlet 108 of channel 104. Method 200 further comprises uniformly distributing viscous material 162 across width CW of channel 104 while urging viscous material 162 through channel 104 from inlet 106 to outlet 108. Method 200 also comprises evenly distributing viscous material 162 from outlet 108 onto surface 182 of workpiece 180 as layer 164. Layer 164 has width LW equal to length OL of outlet 108 and thickness 166 less than or equal to width OW of outlet 108. Width LW of layer 164 is uniform. Thickness 166 of layer 164 is uniform. The preceding subject matter of this paragraph characterizes example 51 of the present disclosure.

Method 200 improves the ease and accuracy of applying a wide layer of viscous material 162 having a uniform thickness onto surface 182 of workpiece 180. More specifically, as viscous material 162 passes through channel 104, viscous material 162 is evenly distributed viscous material 162 across width CW of channel 104 such that viscous material 162 at outlet 108 of channel 104 has a predetermined width and uniform thickness. By facilitating the application onto surface 182 of workpiece 180 of a wide layer of viscous material 162 with a uniform thickness, apparatus 102 reduces time, effort, and inconsistency associated with covering relatively large areas of surface 182 of workpiece 180 with viscous material 162.

Continuing to refer generally to e.g. FIGS. 1-18, and particularly to e.g. FIG. 19A (block 208), method 200 further comprises changing thickness 166 of layer 164. The preceding subject matter of this paragraph characterizes example 52 of the present disclosure, wherein example 52 includes the subject matter of example 51, above.

Different applications may require that layer 164 of viscous material 162 applied to surface 182 of workpiece 180 have different thicknesses. Accordingly, changing thickness 166 of layer 164 may accommodate requirements of different applications.

Continuing to refer generally to e.g. FIGS. 1, 2, 3, 5-14 and 18, and particularly to e.g. FIG. 19A (block 210), changing thickness 166 of layer 164 comprises changing area OA of outlet 108 of channel 104 prior to establishing contact between apparatus 102 and surface 182 of workpiece 180 at angle α. The preceding subject matter of this paragraph characterizes example 53 of the present disclosure, wherein example 53 includes the subject matter of example 52, above.

Based on a predetermined or desired thickness 166 of layer 164, area OA of outlet 108 of channel 104 can be adjusted prior to application of viscous material 162 onto surface 182 to achieve the predetermined or desired thickness 166 of layer 164 when applied onto surface 182.

Continuing to refer generally to e.g. FIGS. 1, 2, 3, and 5-8, and particularly to e.g. FIG. 19B (block 218), changing area OA of outlet 108 of channel 104 comprises moving flap 136 to adjust volume CV of channel 104. The preceding subject matter of this paragraph characterizes example 54 of the present disclosure, wherein example 54 includes the subject matter of example 53, above.

Flap 136 facilitates ease in changing volume CV of channel 104 and cross-sectional area OA of outlet 108. Moving flap 136 may not change width CW of channel 104.

Continuing to refer generally to e.g. FIGS. 1, 9-14, and 18, and particularly to e.g. FIG. 19B (block 220), changing area OA of outlet 108 of channel 104 comprises moving gate 150 at outlet 108 of channel 104. The preceding subject matter of this paragraph characterizes example 55 of the present disclosure, wherein example 55 includes the subject matter of example 53, above.

Gate 150 facilitates ease in changing cross-sectional area OA of outlet 108. Movement of gate 150 relative to wall 126 may not change width CW or volume CV of channel 104. Area OA of outlet 108 may be adjusted by sliding gate 150 relative to wall 126.

Continuing to refer generally to e.g. FIGS. 1, 7-9, and 12-18, and particularly to e.g. FIG. 19A (block 212), changing thickness 166 of layer 164 comprises changing angle α between apparatus 102 and surface 182. The preceding subject matter of this paragraph characterizes example 56 of the present disclosure, wherein example 56 includes the subject matter of any of examples 52-55, above.

Changing angle α between apparatus 102 and surface 182 changes thickness 166 of layer 164 of viscous material 162 applied onto surface 182 by adjusting angle of outlet 108 of channel 104 relative to surface 182. More specifically, as angle α is decreased, angle of outlet 108 of channel 104 relative to surface 182 increases to increase thickness 166 of layer 164 of viscous material 162. In contrast, as angle α is increased, angle of outlet 108 of channel 104 relative to surface 182 decreases to decrease thickness 166 of layer 164 of viscous material 162.

Continuing to refer generally to e.g. FIGS. 1, 7-9, and 12-18, and particularly to e.g. FIG. 19A (block 214), changing angle α between apparatus 102 and surface 182 comprises rotating apparatus 102 relative to surface 182 about curved leading surface 114 extending from outlet 108 of channel 104. The preceding subject matter of this paragraph characterizes example 57 of the present disclosure, wherein example 57 includes the subject matter of example 56, above.

Curved leading surface 114 facilitates ease in moving apparatus 102 along surface 182 of workpiece 180 while apparatus 102 applies viscous material 162 to surface 182 of workpiece 180. Additionally, curved leading surface 114 promotes ease in adjusting an orientation of apparatus 102 relative to surface 182 of workpiece 180. Adjustment of the orientation of apparatus 102 relative to surface 182 may be accomplished by rotating apparatus 102 relative to surface 182 about curved leading surface 114 while curved leading surface is in contact with surface 182. Adjusting the orientation of apparatus 102 relative to surface 182 in this manner may change thickness 166 of layer 164 of viscous material 162 applied onto surface 182.

Continuing to refer generally to e.g. FIGS. 1-18, and particularly to e.g. FIG. 19A block (216), uniformly distributing viscous material 162 across width CW of channel 104 while urging viscous material 162 through channel 104 from inlet 106 of channel 104 to outlet 108 of channel 104 comprises separating viscous material 162 into distinct flow paths. The preceding subject matter of this paragraph characterizes example 58 of the present disclosure, wherein example 58 includes the subject matter of any of examples 51-57, above.

Dividers 110 in channel 104 divide channel 104 into subdivisions 112. Further, dividers 110 help to spread viscous material 162 laterally outwardly to uniformly fill width CW of channel 104 as width CW increases. More specifically, dividers 110 separate viscous material 162 into separate flow paths each defined by a respective one of subdivisions 112.

Examples of the present disclosure may be described in the context of aircraft manufacturing and service method 1100 as shown in FIG. 20 and aircraft 1102 as shown in FIG. 21. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 21, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. An apparatus for applying a viscous material to a surface of a workpiece, the apparatus comprising:

a channel, comprising an inlet and an outlet, and wherein:

the channel has a channel width CW that increases from the inlet to the outlet;

the channel width CW extends across the channel in a first direction;

the outlet has an outlet width, extending in a second direction perpendicular to the first direction; and the outlet has a length extending in the first direction between a first sidewall of the outlet and a second sidewall of the outlet;

dividers inside the channel, and wherein:

each of the dividers extends across the channel in the second direction;

the channel further comprises subdivisions, formed by the dividers;

the subdivisions of the channel are in communication with the inlet and the outlet of the channel;

at least one of the subdivisions of the channel has a subdivision width SW that increases from the inlet of the channel to the outlet of the channel; and the subdivision width extends in the first direction across the channel between the dividers;

a flow regulator, at least partially defining the channel;

a wall, at least partially defining the channel, and wherein:

the flow regulator comprises a flap;

the flap comprises a first end, coupled to the wall at the inlet of the channel, and further comprises a second end, located at the outlet of the channel;

the first end of the flap is hinged to the wall of the channel; and the flap extends in the first direction across the channel from the first sidewall of the outlet to the second sidewall of the outlet; and an actuator, coupled to the flap, and wherein:

the actuator is configured to move at least a portion of the flap relative to the dividers;

the actuator comprises:

a riser, fixed to the flap; and a knob, movably engaging the riser;

the riser extends in the second direction;

the wall is interposed between the flap and the knob and comprises an opening through which the riser extends;

the knob is movable relative to the riser for exerting equal and opposite forces on the riser and on the wall to move the riser and the flap relative to the dividers; and the riser is configured to move through the opening in the wall in the second direction.

2. The apparatus according to claim 1, wherein:

the channel has a volume CV and a cross-sectional area CA, wherein the volume CV is adjustable to any one of first volumetric values or any one of second volumetric values;

the cross-sectional area CA of the channel increases from the inlet of the channel to the outlet of the channel when the volume CV of the channel is held constant at any of at least one of the first volumetric values;

each of the subdivisions of the channel has a volume SV, wherein:

the volume SV of each of the subdivisions is adjustable to any one of third volumetric values; and each of the third volumetric values is less than each of the first volumetric values or each of the second volumetric values; and at least one of the subdivisions of the channel also has a cross-sectional area SA that increases from the inlet of the channel to the outlet of the channel when the volume CV of the channel is held constant at any of at least one of the second volumetric values.

3. The apparatus according to claim 1, wherein:

the channel has a volume CV and a cross-sectional area CA, wherein the volume CV is adjustable to any one of first volumetric values or any one of second volumetric values;

the cross-sectional area CA of the channel stays constant from the inlet of the channel to the outlet of the channel when the volume CV of the channel is held constant at any of at least one of the first volumetric values;

each of the subdivisions of the channel has a volume SV, wherein:

the volume SV of each of the subdivisions is adjustable to any one of third volumetric values; and each of the third volumetric values is less than each of the first volumetric values or each of the second volumetric values; and at least one of the subdivisions of the channel also has a cross-sectional area SA that stays constant from the inlet of the channel to the outlet of the channel when the volume CV of the channel is held constant at any of at least one of the second volumetric values.

4. The apparatus according to claim 1, wherein:

the channel has a volume CV and a cross-sectional area CA, wherein the volume CV is adjustable to any one of first volumetric values or any one of second volumetric values;

the cross-sectional area CA of the channel decreases from the inlet of the channel to the outlet of the channel when the volume CV of the channel is held constant at any of at least one of the first volumetric values;

each of the subdivisions of the channel has a volume SV, wherein:

the volume SV of each of the subdivisions is adjustable to any one of third volumetric values; and each of the third volumetric values is less than each of the first volumetric values or each of the second volumetric values; and at least one of the subdivisions of the channel also has a cross-sectional area SA that decreases from the inlet of the channel to the outlet of the channel when the volume CV of the channel is held constant at any of at least one of the second volumetric values.

5. The apparatus according to claim 1, wherein the dividers are located partially outside the channel.

6. The apparatus according to claim 1, wherein:

the flap comprises slots; and each divider passes through a respective one of the slots.

7. The apparatus according to claim 1, wherein the outlet of the channel has an area OA that is adjustable.

8. The apparatus according to claim 7, wherein:

the channel has a volume CV that is constant; and each of the subdivisions has a volume SV that is constant.

9. The apparatus according to claim 8, further comprising a wall at least partially defining the channel, wherein:

the flow regulator comprises a gate at the outlet; and the gate is movable relative to the wall to adjust the area OA of the outlet.

10. The apparatus according to claim 9, further including means for selectively securing the gate in different positions relative to the wall to adjust the area OA of the outlet.

11. The apparatus according to claim 1, further comprising a curved leading surface extending from the outlet.

12. A system for applying a viscous material to a surface of a workpiece, the system comprising:

a channel, comprising an inlet and an outlet, and wherein:

the channel has a channel width CW that increases from the inlet to the outlet;

the channel width CW extends across the channel in a first direction;

the outlet has an outlet width, extending in a second direction perpendicular to the first direction; and the outlet has a length extending in the first direction between a first sidewall of the outlet and a second sidewall of the outlet;

dividers inside the channel, and wherein:

each of the dividers extends across the channel in the second direction;

the channel further comprises subdivisions, formed by the dividers;

the subdivisions of the channel are in communication with the inlet and the outlet of the channel;

at least one of the subdivisions of the channel has a subdivision width SW that increases from the inlet of the channel to the outlet of the channel; and the subdivision width extends in the first direction across the channel between the dividers;

a flow regulator, at least partially defining the channel;

a wall, at least partially defining the channel, and wherein:

the flow regulator comprises a flap;

the flap comprises a first end, coupled to the wall at the inlet of the channel, and further comprises a second end, located at the outlet of the channel;

the first end of the flap is hinged to the wall of the channel; and the flap extends in the first direction across the channel from the first sidewall of the outlet to the second sidewall of the outlet; and an actuator, coupled to the flap, and wherein:

the actuator is configured to move at least a portion of the flap relative to the dividers;

the actuator comprises:

a riser, fixed to the flap; and a knob, movably engaging the riser;

the riser extends in the second direction;

the wall is interposed between the flap and the knob and comprises an opening through which the riser extends;

the knob is movable relative to the riser for exerting equal and opposite forces on the riser and on the wall to move the riser and the flap relative to the dividers; and the riser is configured to move through the opening in the wall in the second direction; and a material supply device coupled to the channel and configured to supply the viscous material to the channel.

13. The system according to claim 12, further comprising an end effector co-movably coupled to the channel.

14. The apparatus according to claim 2, wherein the second volumetric values are different from the first volumetric values.

15. The apparatus according to claim 3, wherein the second volumetric values are different from the first volumetric values.

16. The apparatus according to claim 4, wherein the second volumetric values are different from the first volumetric values.

17. The apparatus according to claim 1, wherein the flap has a width FW equal to the width CW of the channel at corresponding locations between the inlet and the outlet of the channel.

18. The apparatus according to claim 1, wherein the outlet of the channel has an area OA that is adjustable.

19. The apparatus according to claim 11, wherein the curved leading surface has a constant radius of curvature.

20. The apparatus according to claim 1, further comprising at least one standoff outside the channel, wherein the standoff protrudes a distance D from the outlet.

21. The system according to claim 13, further comprising a controller operably coupled to the end effector to autonomously control movement of the end effector and the channel.

22. The system according to claim 12, wherein:

the channel has a volume CV and a cross-sectional area CA, wherein the volume CV is adjustable to any one of first volumetric values or any one of second volumetric values;

the cross-sectional area CA of the channel increases from the inlet of the channel to the outlet of the channel when the volume CV of the channel is held constant at any of at least one of the first volumetric values;

each of the subdivisions of the channel has a volume SV, wherein:

the volume SV of each of the subdivisions is adjustable to any one of third volumetric values; and each of the third volumetric values is less than each of the first volumetric values or each of the second volumetric values; and at least one of the subdivisions of the channel also has a cross-sectional area SA that increases from the inlet of the channel to the outlet of the channel when the volume CV of the channel is held constant at any of at least one of the second volumetric values.

23. The system according to claim 22, wherein the second volumetric values are different from the first volumetric values.

24. The system according to claim 12, wherein:

the channel has a volume CV and a cross-sectional area CA, wherein the volume CV is adjustable to any one of first volumetric values or any one of second volumetric values;

the cross-sectional area CA of the channel stays constant from the inlet of the channel to the outlet of the channel when the volume CV of the channel is held constant at any of at least one of the first volumetric values;

each of the subdivisions of the channel has a volume SV, wherein:

the volume SV of each of the subdivisions is adjustable to any one of third volumetric values; and each of the third volumetric values is less than each of the first volumetric values or each of the second volumetric values; and at least one of the subdivisions of the channel also has a cross-sectional area SA that stays constant from the inlet of the channel to the outlet of the channel when the volume CV of the channel is held constant at any of at least one of the second volumetric values.

25. The system according to claim 24, wherein the second volumetric values are different from the first volumetric values.

26. The system according to claim 25, wherein:

the channel has a volume CV and a cross-sectional area CA, wherein the volume CV is adjustable to any one of first volumetric values or any one of second volumetric values;

the cross-sectional area CA of the channel decreases from the inlet of the channel to the outlet of the channel when the volume CV of the channel is held constant at any of at least one of the first volumetric values;

each of the subdivisions of the channel has a volume SV, wherein:

the volume SV of each of the subdivisions is adjustable to any one of third volumetric values; and each of the third volumetric values is less than each of the first volumetric values or each of the second volumetric values; and at least one of the subdivisions of the channel also has a cross-sectional area SA that decreases from the inlet of the channel to the outlet of the channel when the volume CV of the channel is held constant at any of at least one of the second volumetric values.

27. The system according to claim 26, wherein the second volumetric values are different from the first volumetric values.

28. The system according to claim 25, wherein the dividers are located partially outside the channel.

29. The system according to claim 12, wherein:

the flap comprises slots; and each divider passes through a respective one of the slots.

30. The system according to claim 12, wherein the flap has a width FW equal to the width CW of the channel at corresponding locations between the inlet and the outlet of the channel.

31. The system according to claim 25, wherein the outlet of the channel has an area OA that is adjustable.

32. The system according to claim 25, further comprising a flow regulator at least partially defining the channel, wherein the outlet of the channel has an area OA that is adjustable.

33. The system according to claim 32, wherein:

the channel has a volume CV that is constant; and each of the subdivisions has a volume SV that is constant.

34. The system according to claim 33, further comprising a wall at least partially defining the channel, wherein:

the flow regulator comprises a gate at the outlet; and the gate is movable relative to the wall to adjust the area OA of the outlet.

35. The system according to claim 34, further including means for selectively securing the gate in different positions relative to the wall to adjust the area OA of the outlet.

36. The system according to claim 25, further comprising a curved leading surface extending from the outlet.

37. The system according to claim 36, wherein the curved leading surface has a constant radius of curvature.

38. The system according to claim 25, further comprising at least one standoff outside the channel, wherein the standoff protrudes a distance D from the outlet.

* * * * *